US012781363B2

(12) United States Patent
Lee et al.

(10) Patent No.: US 12,781,363 B2
(45) Date of Patent: Nov. 3, 2026

(54) MEMBRANE ELECTRODE ASSEMBLY FOR WATER ELECTROLYSIS, WATER ELECTROLYSIS CELL INCLUDING THE MEMBRANE ELECTRODE ASSEMBLY AND METHOD FOR FABRICATING THE MEMBRANE ELECTRODE ASSEMBLY

(71) Applicants: KOREA INSTITUTE OF SCIENCE AND TECHNOLOGY, Seoul (KR); IUCF-HYU (Industry-University Cooperation Foundation Hanyang University), Seoul (KR)

(72) Inventors: So Young Lee, Seoul (KR); Hyoung-Juhn Kim, Seoul (KR); Sae Yane Baek, Seoul (KR); Ju Yeon Lee, Seoul (KR); Young Moo Lee, Seoul (KR); Nanjun Chen, Seoul (KR); Jong Hyeong Park, Seoul (KR)

(73) Assignees: Korea Institute of Science and Technology, Seoul (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 1006 days.

(21) Appl. No.: 17/951,197

(22) Filed: Sep. 23, 2022

(65) Prior Publication Data

US 2023/0366113 A1 Nov. 16, 2023

(30) Foreign Application Priority Data

May 11, 2022 (KR) ..... 10-2022-0057704

(51) Int. Cl.
*C25B 13/08* (2006.01)
*C25B 1/04* (2021.01)

(52) U.S. Cl.
CPC ..... *C25B 13/08* (2013.01); *C25B 1/04* (2013.01)

(58) Field of Classification Search
None
See application file for complete search history.

(56) References Cited

U.S. PATENT DOCUMENTS

2019/0027768 A1* 1/2019 Miyatake ..... C08J 5/2262

FOREIGN PATENT DOCUMENTS

JP 2021-161472 A 10/2021

OTHER PUBLICATIONS

Kraglund, Mikkel Rykær, et al. "Ion-solvating membranes as a new approach towards high rate alkaline electrolyzers." *Energy & environmental science* vol. 12. Issue 11 (2019). pp. 1-6.

(Continued)

*Primary Examiner* — Fred M Teskin
(74) *Attorney, Agent, or Firm* — NSIP Law

(57) ABSTRACT

Disclosed are a membrane electrode assembly for water electrolysis, a water electrolysis cell including the membrane electrode assembly, and a method for fabricating the membrane electrode assembly. An anion exchange membrane of the membrane electrode assembly for water electrolysis includes a polymer having a stable backbone without aryl ether linkages and containing piperidinium groups with high chemical stability and phenyl-based blocks with excellent mechanical properties introduced therein. Due to its structure, the polymer has improved alkaline stability and processability and excellent mechanical properties, based on which the durability of the membrane electrode assembly can be improved. Therefore, the membrane electrode assembly for water electrolysis can be used to manufacture a water electrolyzer with high current density, low resistance, and improved life characteristics.

5 Claims, 14 Drawing Sheets

(56) References Cited

OTHER PUBLICATIONS

Cha, Min Suc, et al. "Poly (carbazole)-based anion-conducting materials with high performance and durability for energy conversion devices." *Energy & Environmental Science* vol. 13. Issue 10 (2020). pp. 1-14.
Xiao, Junwu, et al. "Water-fed hydroxide exchange membrane electrolyzer enabled by a fluoride-incorporated nickel-iron oxyhydroxide oxygen evolution electrode." *ACS Catalysis* vol. 11. Issue 1 (2020). pp. 264-270.
Li, Dongguo, et al. "Highly quaternized polystyrene ionomers for high performance anion exchange membrane water electrolysers." *Nature Energy* vol. 5. Issue 5 (2020). pp. 1-8.
Chen, Pengzuo, et al. "High-Efficiency Anion Exchange Membrane Water Electrolysis Employing Non-Noble Metal Catalysts." *Advanced Energy Materials* vol. 10. Issue 39 (2020). 2002285. pp. 1-6.
Chen, Nanjun, et al. "High-performance anion exchange membrane water electrolyzers with a current density of 7.68 A cm-2 and a durability of 1000 hours." *Energy & Environmental Science* vol. 14. Issue 12 (2021). pp. 6338-6348.
Chen, Nanjun, et al., "Poly (alkyl-terphenyl piperidinium) ionomers and membranes with an outstanding alkaline-membrane fuel-cell performance of 2.58 W cm-2", Angewandte Chemie International Edition, Feb. 2, 2021, (28 Pages in English).
Chen, Nanjun, et al., "Poly (fluorenyl aryl piperidinium) membranes and ionomers for anion exchange membrane fuel cells", Nature communications, 12.1, Apr. 22, 2021, (12 Pages in English).

* cited by examiner

MEMBRANE ELECTRODE ASSEMBLY FOR WATER ELECTROLYSIS, WATER ELECTROLYSIS CELL INCLUDING THE MEMBRANE ELECTRODE ASSEMBLY AND METHOD FOR FABRICATING THE MEMBRANE ELECTRODE ASSEMBLY

CROSS-REFERENCE TO RELATED APPLICATIONS

This application claims priority under 35 U.S.C. § 119 to Korean Patent Application No. 10-2022-0057704 filed on May 11, 2022 in the Korean Intellectual Property Office, the disclosure of which is incorporated herein by reference in its entirety.

BACKGROUND OF THE INVENTION

1. Field of the Invention

The present invention relates to a membrane electrode assembly for water electrolysis, a water electrolysis cell including the membrane electrode assembly, and a method for fabricating the membrane electrode assembly.

2. Description of the Related Art

A global consensus considers the development of green hydrogen energy as crucial for optimizing the current energy structure and achieving sustainable growth for human beings. Low-temperature water electrolyzers have been considered to be an efficient and long-term solution to the production of high-purity hydrogen, with the intention of realizing sustainable energy conversion among renewable energies, electricity, and chemical energy. Conventional alkaline water electrolyzers (AWEs), which generally operate at a current density below 0.4 A/cm$^2$ at 60-90° C. and with a cell voltage of between 1.7 and 2.4 V, are based on a high-concentration alkaline solution (30-40 wt % KOH or NaOH) that is highly sensitive to $CO_2$ exposure in ambient air, resulting in intractable carbonation issues. Proton exchange membrane (PEM) water electrolyzers that use solid polyelectrolytes are a typically used technology to solve the aforementioned issues associated with alkaline water electrolyzers for providing a high current density and cell durability under acidic conditions. However, operating in acidic media raises an inevitable cost disadvantage for proton exchange membrane water electrolyzers that rely on a high load of platinum-group-metal (PGM) electrodes and expensive acid-tolerant hardware.

As a result, in switching from acidic to alkaline media, anion exchange membrane water electrolyzers in tandem with PGM-free catalysts effectively offset the disadvantage of costly proton exchange membrane water electrolyzers. Nevertheless, most anion exchange membrane water electrolyzers have a poor current density (below 1 A/cm$^2$ at 2.0 V) and cell durability (<100 h) under alkaline conditions due to unqualified anion electrode membranes and ionomers, which are key components and prerequisites of anion exchange membrane water electrolyzers. In particular, ideal anion exchange membranes and ionomers should possess simultaneous high ion conductivity, qualified mechanical properties, and long-term durability under alkaline conditions. In fact, anion exchange membranes have been studied most widely in anion exchange membrane fuel cells over the past 20 years, whereas anion exchange membrane and ionomer research with anion exchange membrane water electrolyzers is still at an early stage. Although many anion exchange membranes, such as imidazolium or benzyl trimethylammonium (BTMA)-based aryl ether polymers, alkylammonium polyphenylenes, and alkylammonium poly(carbazole) s, have been employed for anion exchange membrane water electrolyzers, few have displayed a satisfactory current density.

Typically, commercial Sustainion® anion exchange membrane-based anion exchange membrane water electrolyzers have obtained a 1 A/cm$^2$ current density at 1.63 V in 1 M KOH at 60° C. Kraglund et al. achieved a current density of 1.7 A/cm$^2$ at 1.8 V in 24 wt % KOH at 80° C. using polybenzimidazole anion exchange membranes (Kraglund, M. R. et al. Ion-solvating membranes as a new approach towards high rate alkaline electrolyzers. Energy Environment. Sci. 12, 3313-3318 (2019)). Cha et al. reported alkylammonium poly(carbazole) anion exchange membrane-based anion exchange membrane water electrolyzers, and the cells reached a high current density of 3.5 A/cm$^2$ at 1.9 V (1 M KOH at 70° C.), although they displayed a poor cell durability of ~3 h (Cha, M. S. et al. Poly(carbazole)-based anion-conducting materials with high performance and durability for energy conversion devices. Energy Environment. Sci. 13, 3633-3645 (2020)). Yan et al. presented poly(aryl piperidinium)-based anion exchange membrane water electrolyzers and achieved a current density of 1.02 A/cm$^2$ at 1.8 V in pure water, along with a cell durability of ~160 h at 0.2 A/cm$^2$ (Xiao, J. et al. Water-Fed Hydroxide Exchange Membrane Electrolyzer Enabled by a Fluoride-Incorporated Nickel-Iron Oxyhydroxide Oxygen Evolution Electrode. ACS Catal. 11, 264-270 (2020)). Kim and coworkers reported high-performance anion exchange membrane water electrolyzers based on alkylammonium polyphenylene anion exchange membranes and BTMA-polystyrene ionomers, where the cells reached an excellent current density of 2.7 A/cm$^2$ at 1.8 V in pure water (~5.5 A/cm$^2$ in 1 M KOH) at 85° C., although the in situ durability remained limited at below 170 h at 85° C. under 0.2 A/cm$^2$ (Li, D. et al. Highly quaternized polystyrene ionomers for high performance anion exchange membrane water electrolysers. Nat. Energy 5, 378-385 (2020)). On the other hand, most anion exchange membrane water electrolyzers are based on PGM catalysts, and research on PGM-free anion exchange membrane water electrolyzers is lacking. Hu et al. reported NiMo/Fe—NiMo-based anion exchange membrane water electrolyzers that reached a current density of 1 A/cm$^2$ at 1.57 V in 1 M KOH (Chen, P. & Hu, X. High Efficiency Anion Exchange Membrane Water Electrolysis Employing Non Noble Metal Catalysts. Adv. Energy Mater. 10, 2002285 (2020)). These state-of-the-art anion exchange membrane water electrolyzers indicate that current densities have advanced dramatically over the past two years, while their in situ durability is limited at below 200 h at a low current density. The current density of most anion exchange membrane water electrolyzers is far lower than that of state-of-the-art proton exchange membrane water electrolyzers (6 A/cm$^2$ at 2.0 V). Thus, there is an urgent need to develop highly efficient and durable anion exchange membrane water electrolyzers.

SUMMARY OF THE INVENTION

The present invention has been made in an effort to solve the above-described problems, and one object of the present invention is to provide a membrane electrode assembly for water electrolysis in which an anion exchange membrane including a polymer having no aryl ether linkages in the polymer backbone and containing phenyl-based blocks and piperidinium groups introduced therein is introduced, achieving significantly improved water electrolysis performance based on excellent mechanical properties, good processability, and high ion conductivity of the polymer. A further object of the present invention is to provide a water electrolysis cell including the membrane electrode assembly.

Another object of the present invention is to provide a method for fabricating the membrane electrode assembly.

One aspect of the present invention provides a membrane electrode assembly for water electrolysis, including: an anion exchange membrane including a first polymer; a cathode located on one surface of the anion exchange membrane; and an anode located on the other surface of the anion exchange membrane, wherein the first polymer includes at least one repeating unit selected from those represented by Formulae 1 to 5:

(1)

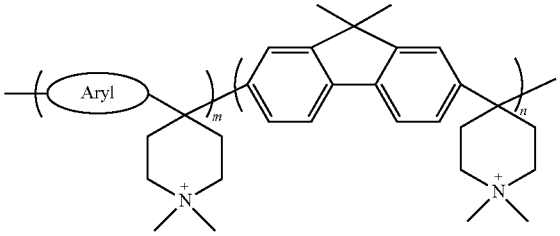

wherein Aryl is

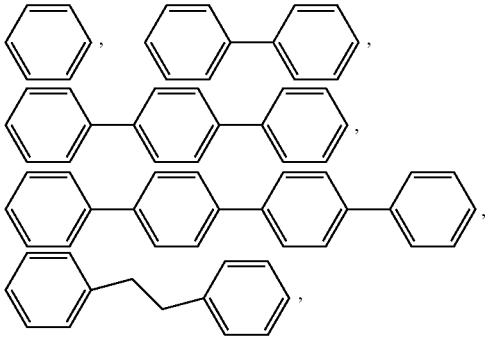

-continued

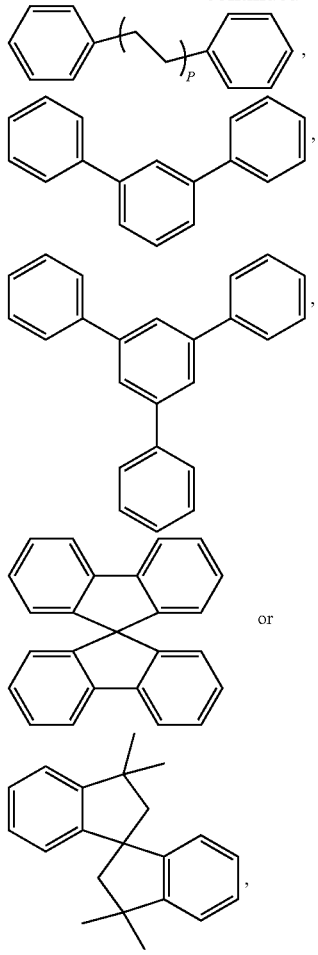

and m and n represent the mole fractions (%) of the corresponding repeating units and satisfy m>0, n>0, and m+n=100;

(2)

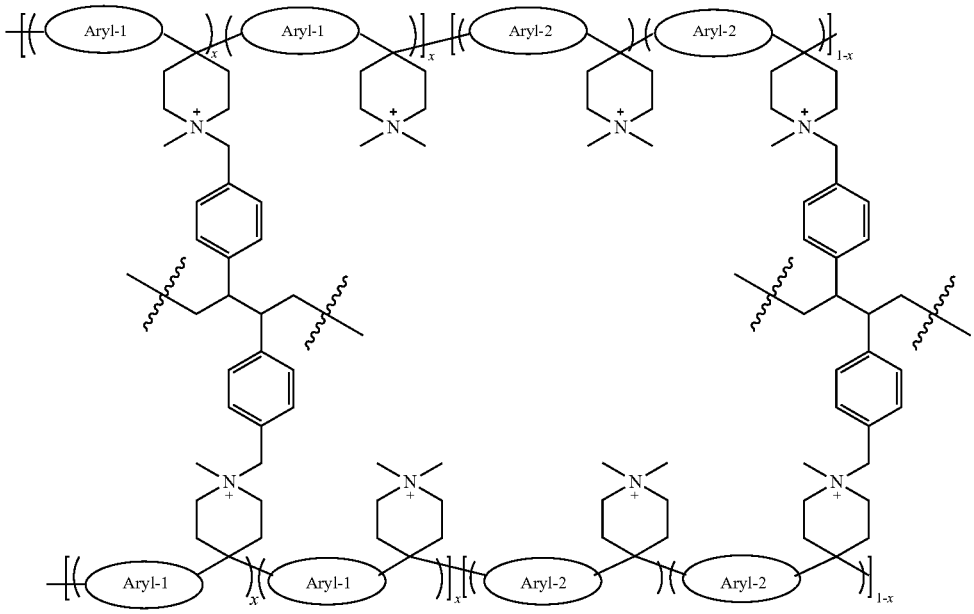

wherein each Aryl-1 is
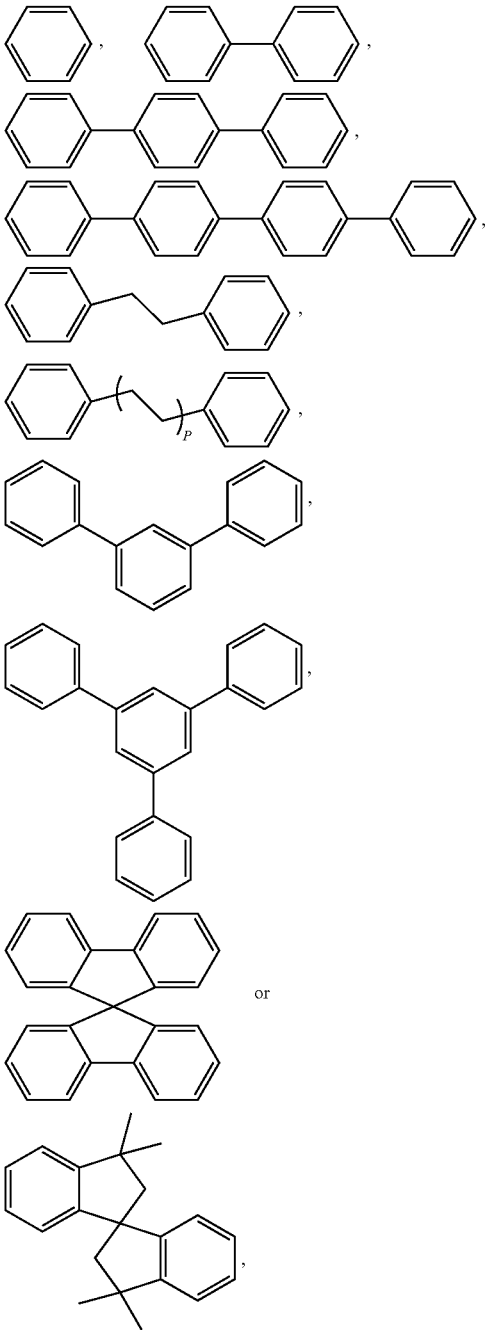
each Aryl-2 is
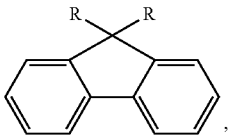
and x and 100-x represent the mole fractions (%) of the corresponding repeating units;
(3)
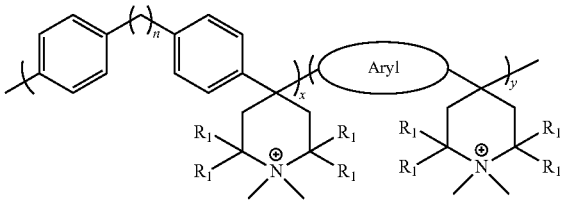
wherein Aryl is,
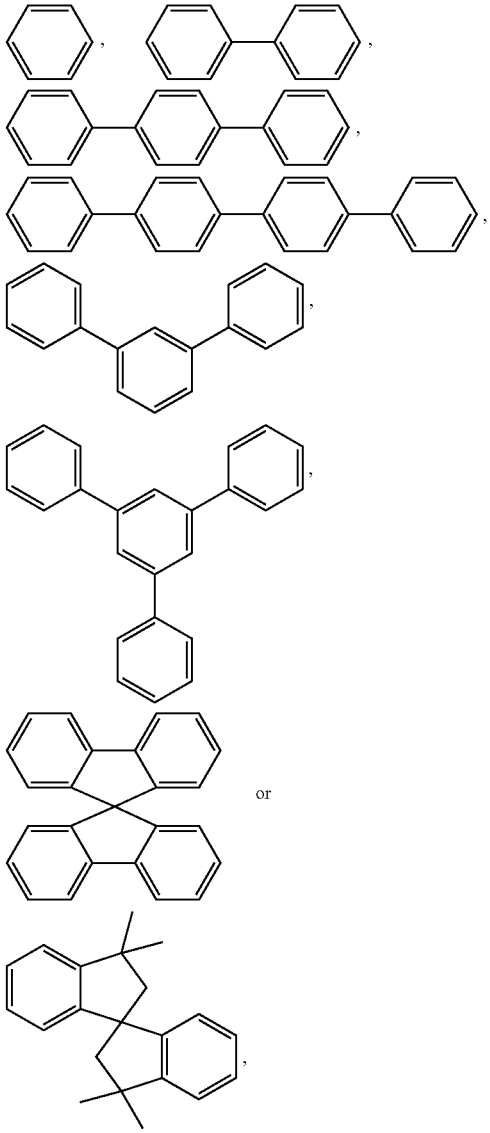
x and y represent the mole fractions (%) of the corresponding repeating units and satisfy x>0, y>0, and x+y=100, and n is an integer from 1 to 10;

(4)

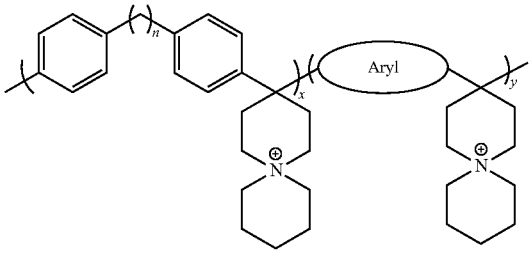

wherein Aryl, x, y, and n are as defined in Formula 3; and (5)

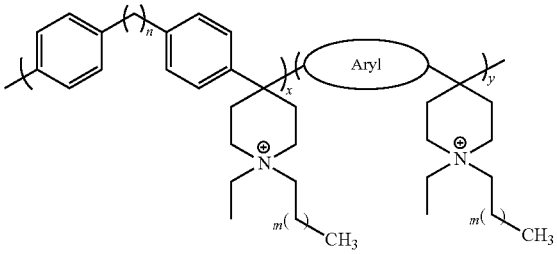

wherein Aryl, x, y, and n are as defined in Formula 3 and each m is independently an integer from 1 to 10.

A further aspect of the present invention provides a method for fabricating a membrane electrode assembly for water electrolysis, including (A) dissolving a first polymer in a solvent, and casting and drying the polymer solution on a substrate to prepare an anion exchange membrane, (B) applying a cathode catalyst ink including a solvent and a cathode catalyst to one surface of the anion exchange membrane and drying the cathode catalyst ink to form a cathode, and (C) applying an anode catalyst ink including a solvent and an anode catalyst to the other surface of the anion exchange membrane and drying the anode catalyst ink to form an anode, wherein the first polymer includes at least one repeating unit selected from those represented by Formulae 1 to 5.

Another aspect of the present invention provides a water electrolysis cell including the membrane electrode assembly for water electrolysis.

The anion exchange membrane of the membrane electrode assembly for water electrolysis according to the present invention includes a polymer having a stable backbone without aryl ether linkages and containing piperidinium groups with high chemical stability and phenyl-based blocks with excellent mechanical properties introduced therein. Due to its structure, the polymer has improved alkaline stability and processability and excellent mechanical properties, based on which the durability of the membrane electrode assembly can be improved. Therefore, the membrane electrode assembly for water electrolysis can be used to manufacture a water electrolyzer with high current density, low resistance, and improved life characteristics.

BRIEF DESCRIPTION OF THE DRAWINGS

These and/or other aspects and advantages of the invention will become apparent and more readily appreciated from the following description of the embodiments, taken in conjunction with the accompanying drawings of which:

(FIG. 4B), and I-V curves (FIG. 4C) and electrochemical impedance spectra (EIS) at 80° C. (FIG. 4D) for water electrolysis cells using PGM membrane electrode assemblies fabricated in Examples 1 to 3;

(FIG. 5B), and I-V curves at 80° C. (FIG. 5C) for water electrolysis cells using PGM membrane electrode assemblies fabricated in Examples 2, 4, and 5, and Comparative Example 2;

DETAILED DESCRIPTION OF THE INVENTION

Figure 1:
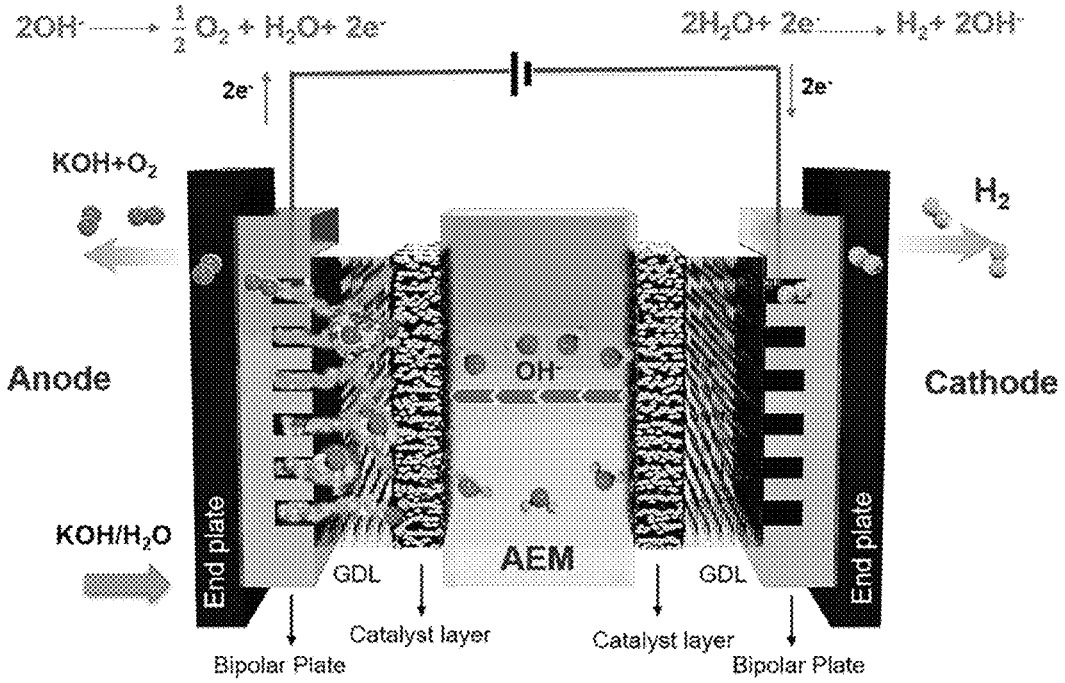
FIG. 1 is a schematic diagram of a water electrolytic cell without water-feeding electrodes.

The present invention will now be described in more detail with reference accompanying drawings, in which exemplary embodiments of the invention are shown.

Each R in the chemical structures shown herein represents a hydrogen atom or a $C_1$-$C_{10}$ alkyl group.

The present invention provides a membrane electrode assembly for water electrolysis, including: an anion exchange membrane including a first polymer; a cathode located on one surface of the anion exchange membrane; and an anode located on the other surface of the anion exchange membrane, wherein the first polymer includes at least one repeating unit selected from those represented by Formulae 1 to 5:

(1)

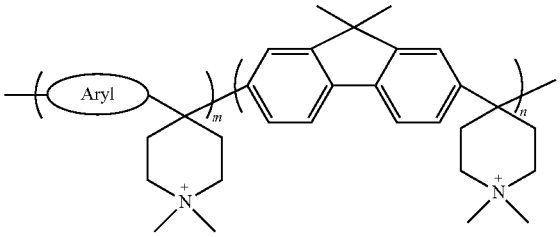

wherein Aryl is

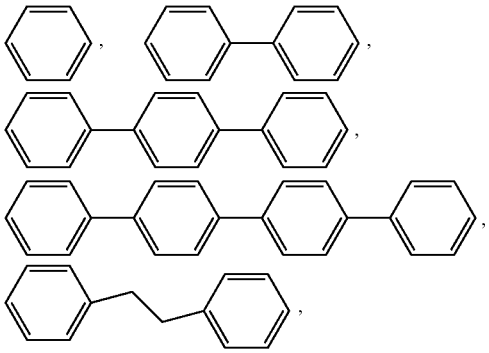

-continued

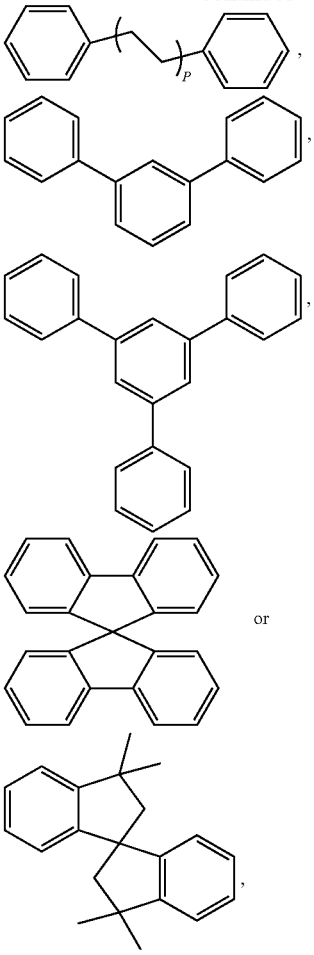

and m and n represent the mole fractions (%) of the corresponding repeating units and satisfy m>0, n>0, and m+n=100;

(2)

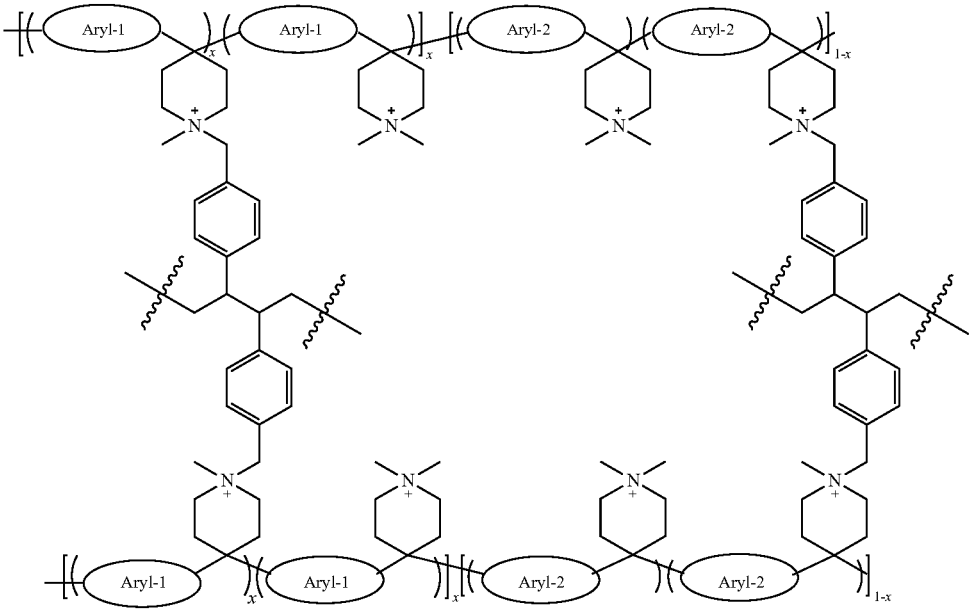

wherein each Aryl-1 is
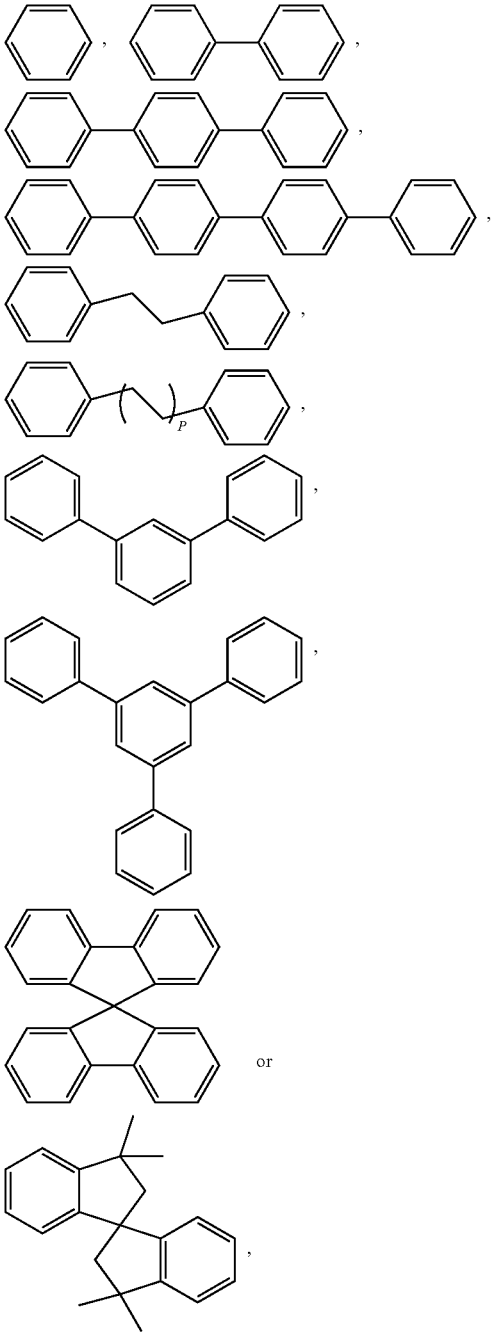
each Aryl-2 is
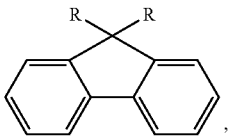
and x and 100-x represent the mole fractions (%) of the corresponding repeating units;
(3)
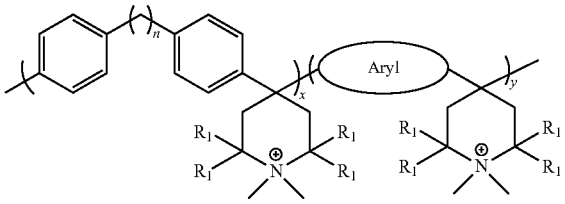
wherein Aryl
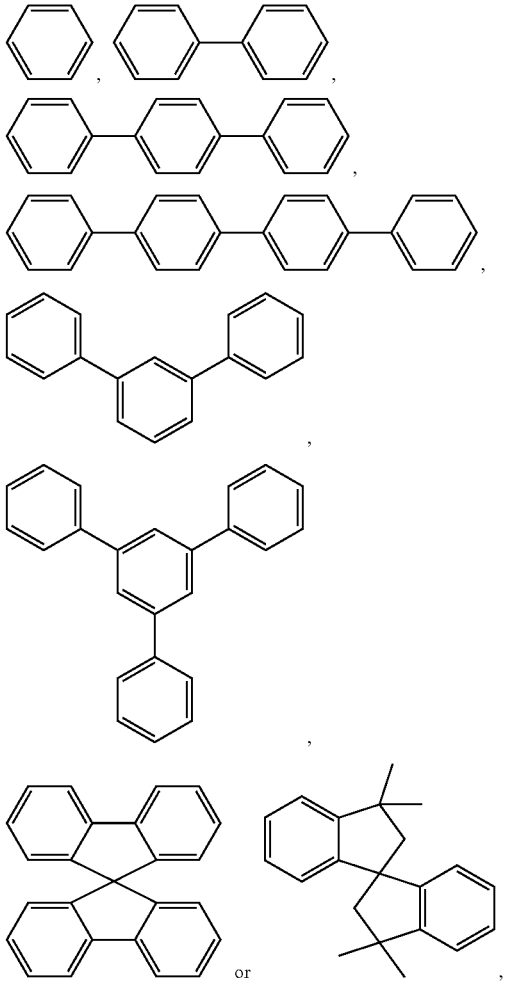
x and y represent the mole fractions (%) of the corresponding repeating units and satisfy x>0, y>0, and x+y=100, and n is an integer from 1 to 10;

(4)

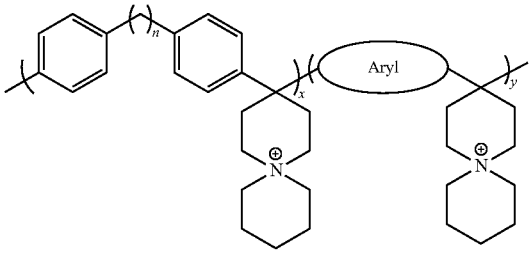

wherein Aryl, x, y, and n are as defined in Formula 3; and (5)

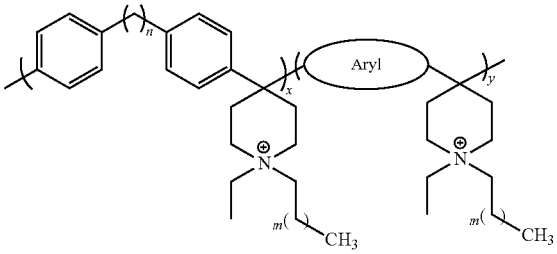

wherein Aryl, x, y, and n are as defined in Formula 3 and each m is independently an integer from 1 to 10.

The first polymer present in the anion exchange membrane of the membrane electrode assembly for water electrolysis according to the present invention has no aryl ether linkages in the polymer backbone and contains piperidinium groups and phenyl-based blocks introduced in the repeating unit. Due to the absence of aryl ether linkages, the backbone of the first polymer is stable and decomposition behavior of the first polymer by hydroxyl radicals is not involved, ensuring good long-term stability of the first polymer. In addition, the introduction of piperidinium groups with high chemical stability ensures high stability of the anion exchange membrane even in alkaline media and allows the anion exchange membrane to have a high ion exchange capacity (IEC), achieving high ion conductivity of the anion exchange membrane. The presence of the phenyl-based blocks greatly improves the film-forming ability and mechanical properties of the first polymer, enabling the formation of an electrolyte membrane over a large area. Due to its high water permeability, the first polymer can improve water diffusion when applied to water electrolysis, making it easy to address water management issues.

The first polymer includes fluorene-based blocks, as shown in Formulae 1 and 2. The presence of the fluorene-based blocks improves the water diffusivity of the anion exchange membrane and significantly improves the rigidity and phase-separated morphology of the anion exchange membrane to increase the dimensional stability and ion conductivity. The introduction of piperidinium groups in the first polymer significantly improves the ion conductivity and alkaline stability of the anion exchange membrane. The presence of the phenyl-based blocks in the repeating unit represented by Formula 1 or 2 can greatly improve film-forming ability and mechanical properties of the first polymer. The phenyl-based blocks may be selected from phenyl, biphenyl, terphenyl, quaterphenyl, as defined in Formulae 1 and 2. The phenyl-based block may be a diphenyl in which the two phenyl groups are connected to each other via a C2+ alkylene

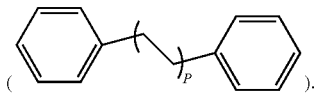

In this case, the alkylene may be a $C_2$-$C_{10}$ one.

In Formula 1, the ratio men is preferably 50:50 to 99:1, more preferably 80:20 to 95:5. Particularly, if the mole fraction m is less than 80, the relatively reduced amount of the phenyl-based blocks may greatly deteriorate the film-forming ability of the first polymer. Meanwhile, if the mole fraction m exceeds 95, the relatively increased amount of the fluorene-based blocks may greatly deteriorate the mechanical properties of the first polymer. Thus, it is more preferred that the ratio men is limited to 80:20 to 95:5.

Even when the first polymer including the repeating unit represented by Formula 2 has a smaller number of phenyl-based blocks than the first polymer including the repeating unit represented by Formula 1, the first polymer including the repeating unit represented by Formula 2 may have better film-forming ability than the first polymer including the repeating unit represented by Formula 1 due to the presence of crosslinked polystyrene. The crosslinked structure enhances the mechanical properties of the first polymer despite the lower fraction of the polyfluorene-based blocks. The ratio x: 100-x in the polymer backbone in Formula 2 is 50:50 to 99:1, preferably 70:30 to 97:3. Particularly, if the mole fraction x is less than 70, the relatively reduced amount of the phenyl-based blocks may greatly deteriorate the film-forming ability of the first polymer. Meanwhile, if the mole fraction x exceeds 97, the relatively increased amount of the fluorene-based blocks may greatly deteriorate the mechanical properties of the first polymer. Thus, it is more preferred that the ratio x: 100-x is limited to 70:30 to 97:3. In addition, the degree of crosslinking of polystyrene in the first polymer having the repeating unit represented by Formula 2 is 1% to 30%, preferably 3% to 25%, more preferably 7 to 15%, most preferably 8 to 12%.

As shown in Formulae 3 to 5, the first polymer consists of a stable backbone containing aliphatic chains and having no aryl ether linkages, piperidinium groups with high chemical stability, and phenyl-based blocks. Aryl may be selected from aryls such as phenyl, biphenyl, terphenyl, and quaterphenyl, as defined in Formulae 3 to 5, and heteroaryls such as carbazolyl, dibenzofuranyl, and dibenzothiophenyl.

In Formulae 3 to 5, each n may be an integer from 1 to 10. That is, in the diphenyl structure, the two phenyl groups are connected to each other via a $C_2$-$C_{10}$ alkylene. The alkylene may have as few as 1 or 2 carbon atoms or as many as 6 to 10 carbon atoms. For example, the diphenyl structure may be diphenylmethane when n is 1, diphenylethane when n is 2, diphenylhexane when n is 6 or diphenyldecane when n is 10. The diphenyl structure is more preferably diphenylethane (n=2).

In Formulae 3 to 5, each m may be an integer from 1 to 10.

In Formulae 3 to 5, x and y represent the mole fractions of the corresponding repeating units and the ratio x:y is 1:99 to 99:1, preferably 20:80 to 80:20. If the mole fraction x is less than 20, the relatively reduced amount of the alkyl-based blocks may deteriorate the dimensional stability of the first polymer. Meanwhile, if the mole fraction x exceeds 80, the relatively reduced amount of the phenyl-based blocks may deteriorate the film-forming ability of the first polymer. Thus, it is preferred that the ratio x:y is limited to 20:80 to 80:20.

The cathode and the anode may each independently include at least one metal selected from the group consisting of platinum, ruthenium, rhodium, palladium, osmium, and iridium. In this case, the metal may be supported on carbon.

The anode and the cathode may each independently include at least one non-platinum group metal-based catalyst selected from the group consisting of Ni—Fe, Ni—$Fe_2O_4$, Ni—Mo, Fe—NiMo—$NH_3$, NiMo$NH_3$, Ni, Mn, Co, Cr, Sn, Zn, Cr, and Ce. Since the first polymer present in the anion exchange membrane of the membrane electrode assembly has excellent mechanical strength and high ion conductivity, the membrane electrode assembly can be used to manufacture a water electrolysis cell with significantly improved current density and in situ durability without the need to use a platinum group catalyst. In addition, the use of the non-platinum group metal-based catalyst is preferred in that a water electrolytic cell can be manufactured at reduced cost.

The first polymer may have a repeating unit represented by Formula 6:

(6)

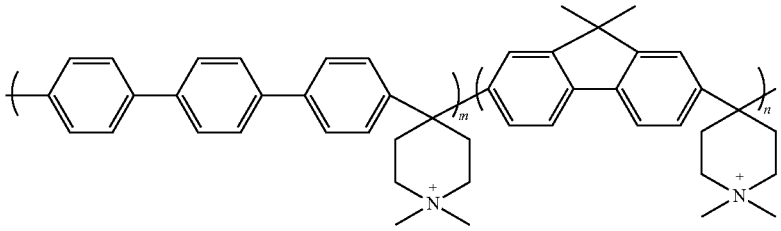

wherein m and n represent the mole fractions (%) of the corresponding repeating units and satisfy m+n=100, and the ratio men is 85:15 to 90:10.

The first polymer may have a repeating unit represented by Formula 7:

(7)

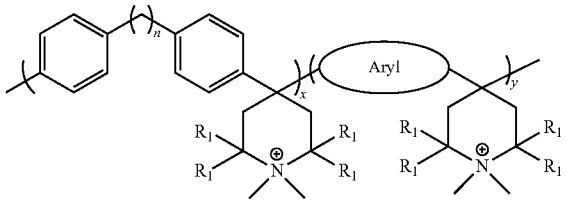

wherein Aryl is

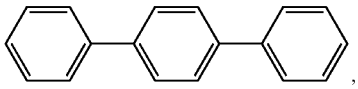

n is 2, $R_1$ is hydrogen, x and y represent the mole fractions (%) of the corresponding repeating units and satisfy x+y=100, and the ratio x:y is 23:77 to 30:70.

The first polymer having the repeating unit represented by Formula 6 or 7 has high ion conductivity and water diffusivity. As a result, water diffusion from the anode to the cathode through the first polymer is improved, resulting in a reduction in charge transfer resistance and an improvement in current density. Due to these advantages, the first polymer can be used to manufacture a water electrolysis cell with improved electrochemical performance. The high mechanical strength of the first polymer can significantly improve the durability of the water electrolysis cell.

The cathode may include a cathode ionomer including a second polymer, the anode may include an anode ionomer including a third polymer, and the second and third polymers may each independently have the repeating unit represented by Formula 1.

Each of the cathode and the anode of the membrane electrode assembly includes an ionomer composed of a polymer having the repeating unit represented by Formula 1, resulting in a reduction in cell resistance and a significant improvement in mass transportation.

The second polymer may have a repeating unit represented by Formula 8:

(8)

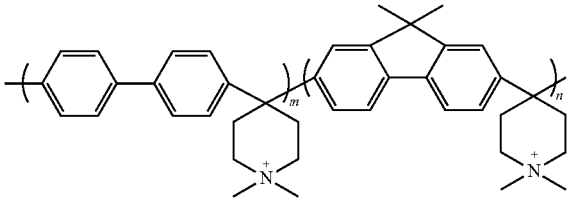

wherein m and n represent the mole fractions (%) of the corresponding repeating units and satisfy m+n=100, and the ratio min is 83:17 to 90:10.

The polymer having the repeating unit represented by Formula 8 has excellent ion exchange capacity (IEC), water uptake, and water diffusivity so that it can quickly catch diffusing water from the anode when applied to a cathode ionomer. Accordingly, the use of the polymer can lead to a significant improvement in the performance of the water electrolysis cell.

The second polymer may be present in an amount of 24 to 26% by weight, based on the total weight (100% by weight) of the cathode, and the third polymer may be present in an amount of 5 to 20% by weight, based on the total weight of the anode. If the content of the anode ionomer and/or the content of the cathode ionomer is less than the corresponding lower limit, the secondary pore size of the catalyst layer is small such that the transportation of reactants to catalytically active sites is reduced, and as a result, the charge transfer resistance increases, resulting in a low current density. Meanwhile, if the content of the anode ionomer and/or the content of the cathode ionomer exceeds the corresponding upper limit, the excess ionomer may block the active sites of the electrochemical catalyst, resulting in a significant improvement in charge transfer resistance.

According to the most preferred embodiment of the present invention, the first polymer has a repeating unit represented by Formula 6 or 7:

(6)

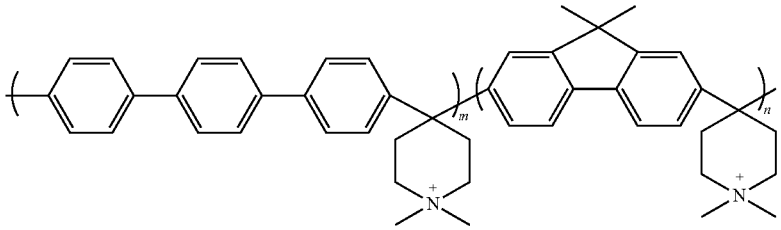

wherein m and n represent the mole fractions (%) of the corresponding repeating units and satisfy m+n=100, and the ratio min is 85:15 to 90:10, (7)

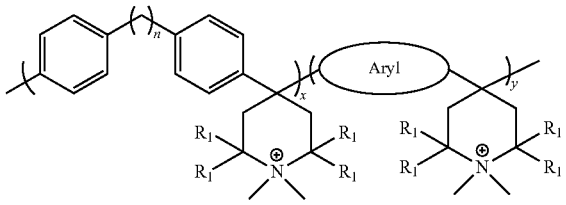

wherein Aryl is

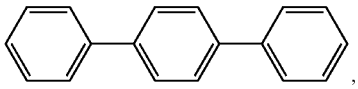

n is 2, $R_1$ is hydrogen, x and y represent the mole fractions (%) of the corresponding repeating units and satisfy x+y=100, and the ratio x:y is 23:77 to 30:70, the second polymer has a repeating unit represented by Formula 8:

(8)

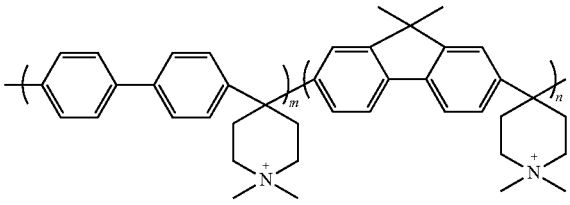

wherein m and n represent the mole fractions (%) of the corresponding repeating units and satisfy m+n=100, and the ratio men is 83:17 to 90:10, the third polymer has a repeating unit represented by Formula 9:

(9)

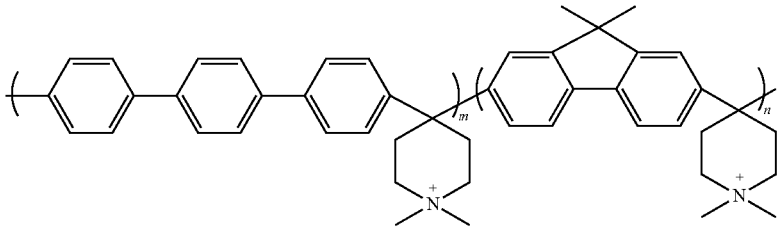

wherein m and n represent the mole fractions (%) of the corresponding repeating units and satisfy m+n=100, and the ratio men is 91:9 to 95:5, the second polymer is present in an amount of 24 to 26% by weight, based on the total weight of the cathode, and the third polymer is present in an amount of 7 to 15% by weight, based on the total weight of the anode.

When the structures of the repeating units of the first to third polymers, the mole fractions (%) of the repeating units, and the contents of the ionomers satisfy the above respective conditions, the first to third polymers can be used together with a platinum group catalyst to manufacture a water electrolysis cell with significantly improved current density and in situ durability (~1100 hours). However, if any one of the above conditions is not satisfied, the current density is not improved to a considerable extent, a drastic voltage decay occurs from after 800 hours, and the in situ durability deteriorates.

The present invention also provides a method for fabricating a membrane electrode assembly for water electrolysis, including (A) dissolving a first polymer in a solvent, and casting and drying the polymer solution on a substrate to prepare an anion exchange membrane, (B) applying a cathode catalyst ink including a solvent and a cathode catalyst to one surface of the anion exchange membrane and drying the cathode catalyst ink to form a cathode, and (C) applying an anode catalyst ink including a solvent and an anode catalyst to the other surface of the anion exchange membrane and drying the anode catalyst ink to form an anode, wherein the first polymer includes at least one repeating unit selected from those represented by Formulae 1 to 5:

(1)

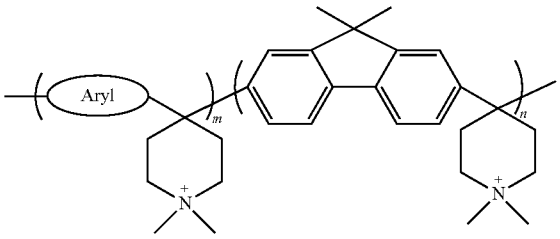

wherein Aryl is,

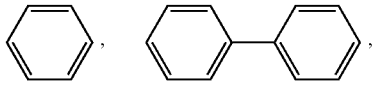

-continued

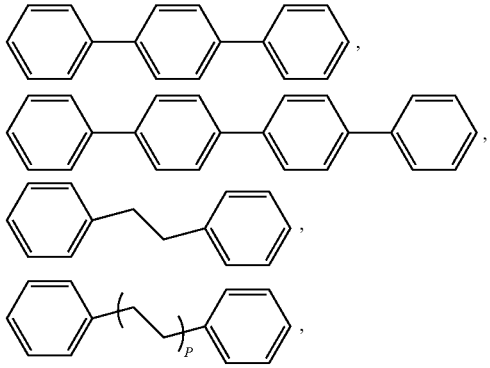

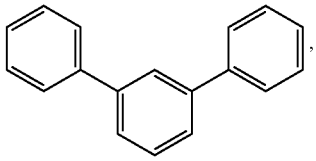

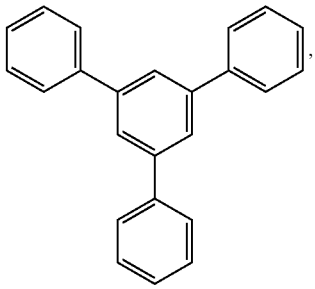

or

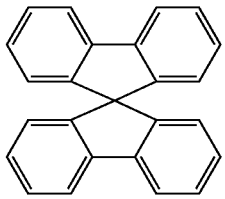

-continued
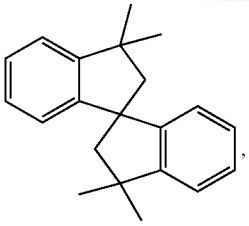
and m and n represent the mole fractions (%) of the corresponding repeating units and satisfy m>0, n>0, and m+n=100;
(2)
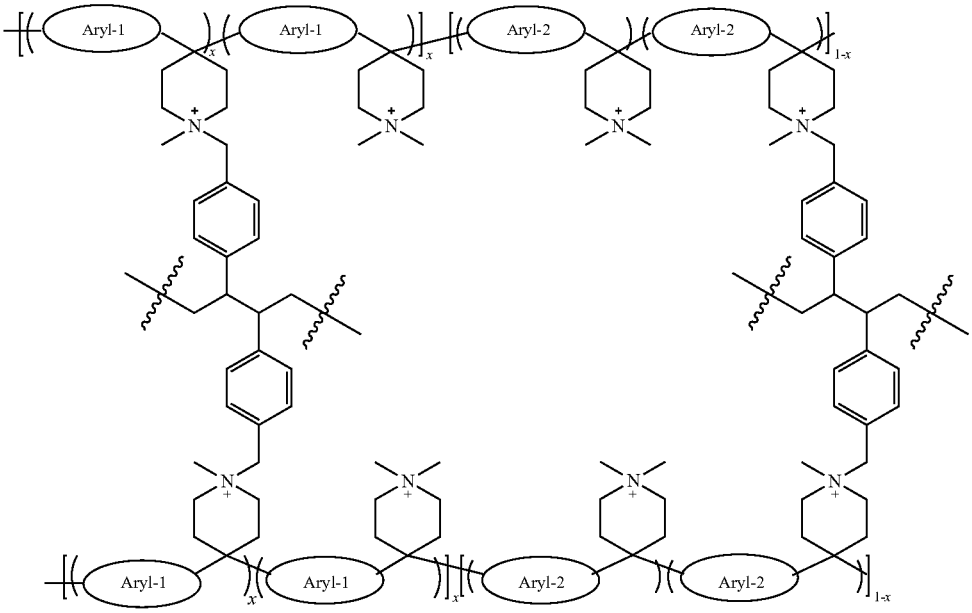
wherein each Aryl-1 is
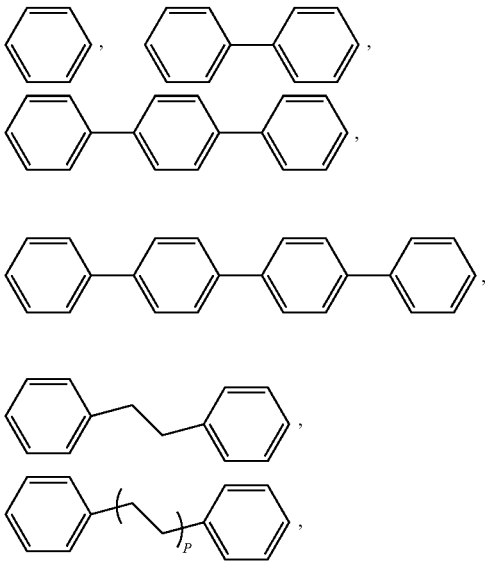
-continued
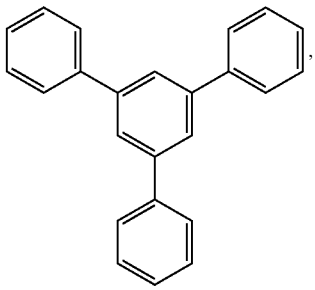
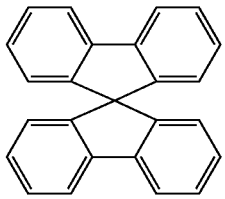
or
-continued
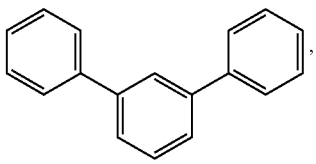

-continued

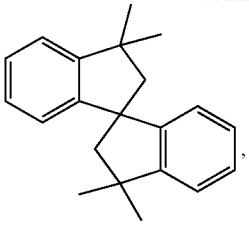

each Aryl-2 is

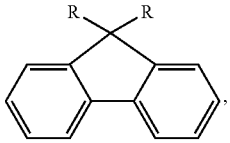

and x and 100-x represent the mole fractions (%) of the corresponding repeating units;

(3)

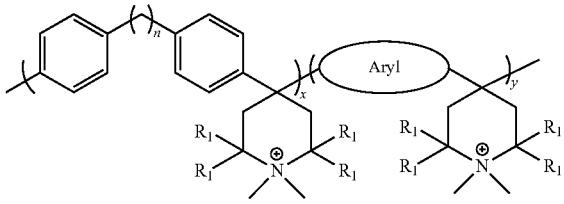

wherein Aryl

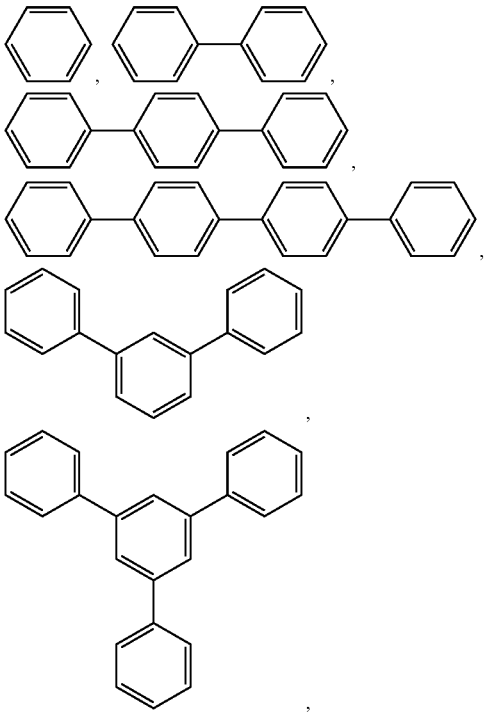

-continued

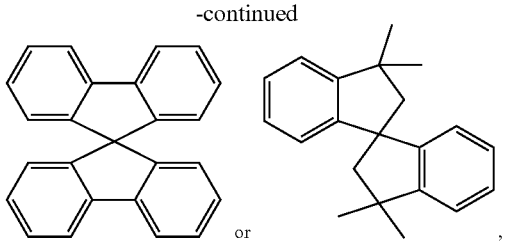

x and y represent the mole fractions (%) of the corresponding repeating units and satisfy x>0, y>0, and x+y=100, and n is an integer from 1 to 10;

(4)

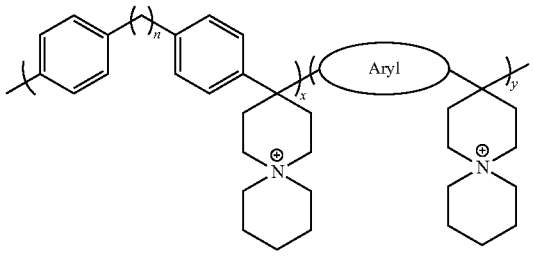

wherein Aryl, x, y, and n are as defined in Formula 3; and (5)

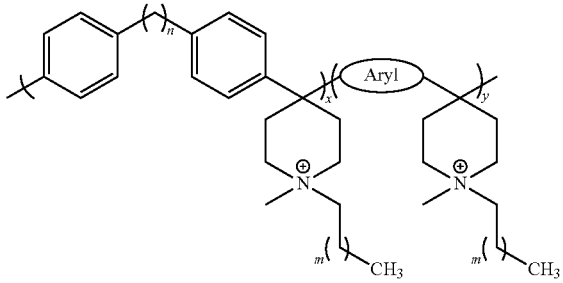

wherein Aryl, x, y, and n are as defined in Formula 3 and each m is independently an integer from 1 to 10.

The first polymer including at least one of the repeating units represented by Formulae 1 to 5 is the same as that described above, and a detailed description thereof is thus omitted.

The solvents used in steps (A) to (C) may each independently be water, isopropyl alcohol, propanol, butanol, N-methylpyrrolidone, dimethylacetamide, dimethyl sulfoxide or dimethylformamide.

The cathode catalyst and the anode catalyst may each independently include at least one metal selected from the group consisting of platinum, ruthenium, rhodium, palladium, osmium, and iridium.

The cathode catalyst and the anode catalyst may each independently include at least one non-platinum group metal-based catalyst selected from the group consisting of Ni—Fe, Ni—$Fe_2O_4$, Ni—Mo, Fe—NiMo—$NH_3$, $NiMoNH_3$, Ni, Mn, Co, Cr, Sn, Zn, Cr, and Ce.

The method may further include, after step (A), immersing the anion exchange membrane in a NaOH, NaCl or $NaCO_3$ solution to convert a halide form (for example, $I^-$ form) of the first polymer to a OH, Cl or $CO_3^{2-}$ form.

In step (A), the drying is performed at 50 to 200° C., preferably 70 to 180° C. for 12 to 48 hours, preferably 18 to 36 hours. If the drying time and temperature are less than the respective lower limits, the solvent may remain on the separation membrane. Meanwhile, if the drying time and temperature exceed the respective upper limits, the separation membrane may be thermally decomposed, which shortens its service life.

In step (A), the polymer solution may include 0.5 to 5% by weight of the first polymer, based on the total weight thereof. If the first polymer is present in an amount of less than 0.5% by weight, there may be difficulty in forming the membrane. Meanwhile, if the first polymer is present in an amount exceeding 5% by weight, the viscosity of the polymer solution may increase, making it difficult to form the membrane to a predetermined thickness or deteriorating the physical properties of the membrane.

In each of steps (B) and (C), the drying is performed at a temperature of 10 to 100° C., preferably 20 to 80° C., for 12 to 36 hours, preferably 18 to 32 hours. If the drying time and temperature are less than the respective lower limits, the solvent of the catalyst ink is not sufficiently removed by evaporation, and as a result, the catalyst is not attached to the separation membrane by the residual solvent and is detached from the separation membrane, with the result that as water electrolysis proceeds, the catalyst is lost or acts as a poison. Meanwhile, if the drying time and temperature exceed the respective upper limits, the difference between the temperature of a hot plate used and room temperature becomes large, and as a result, the surface of the final membrane electrode assembly tends to crack and degrade, with the result that the physical properties of the membrane electrode assembly deteriorate and defects such as holes are formed on the membrane electrode assembly, resulting in a significant deterioration in the performance of the membrane electrode assembly.

The first polymer may have a repeating unit represented by Formula 6:

(6)

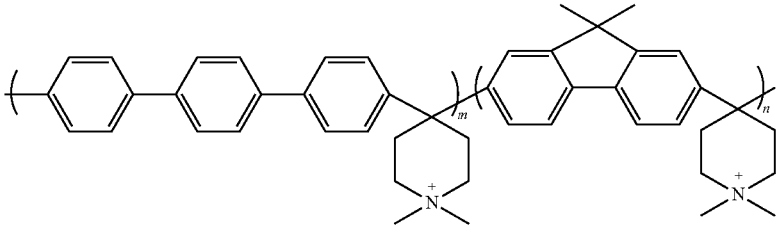

wherein m and n represent the mole fractions (%) of the corresponding repeating units and satisfy m+n=100, and the ratio men is 85:15 to 90:10.

The first polymer may have a repeating unit represented by Formula 7:

(7)

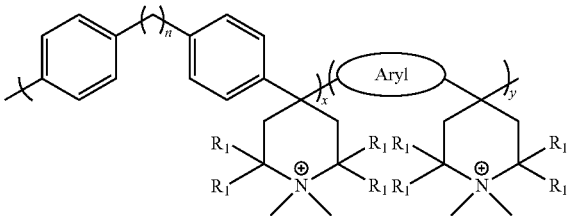

wherein Aryl is

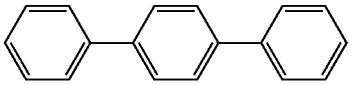

, n is 2, $R_1$ is hydrogen, x and y represent the mole fractions (%) of the corresponding repeating units and satisfy x+y=100, and the ratio x:y is 23:77 to 30:70.

The cathode catalyst ink may further include a cathode ionomer including a second polymer, the anode catalyst ink may further include an anode ionomer including a third polymer, and the second and third polymers may each independently have the repeating unit represented by Formula 1.

The second polymer may have a repeating unit represented by Formula 8:

(8)

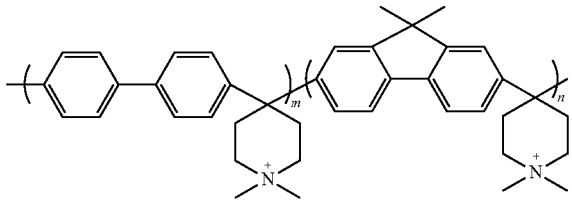

wherein m and n represent the mole fractions (%) of the corresponding repeating units and satisfy m+n=100, and the ratio men is 83:17 to 90:10.

The second polymer may be present in an amount of 24 to 26% by weight, based on the total weight of the cathode, and the third polymer may be present in an amount of 5 to 20% by weight, based on the total weight of the anode.

The first polymer may have a repeating unit represented by Formula 6 or 7:

(6)

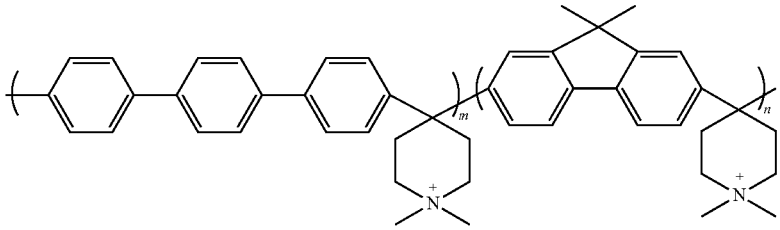

wherein m and n represent the mole fractions (%) of the corresponding repeating units and satisfy m+n=100, and the ratio min is 85:15 to 90:10, (7)

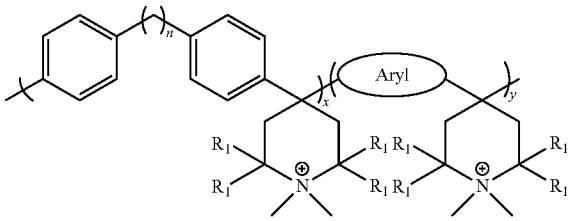

wherein Aryl is

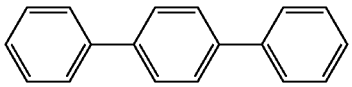

n is 2, $R_1$ is hydrogen, x and y represent the mole fractions (%) of the corresponding repeating units and satisfy x+y=100, and the ratio x:y is 23:77 to 30:70, the second polymer has a repeating unit represented by Formula 8:

(8)

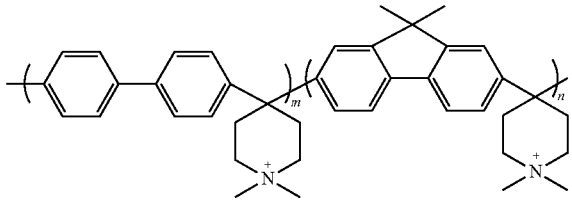

wherein m and n represent the mole fractions (%) of the corresponding repeating units and satisfy m+n=100, and the ratio men is 83:17 to 90:10, the third polymer has a repeating unit represented by Formula 9:

(9)

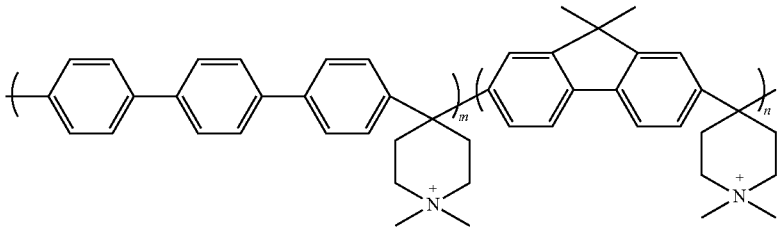

wherein m and n represent the mole fractions (%) of the corresponding repeating units and satisfy m+n=100, and the ratio min is 91:9 to 95:5, the second polymer is present in an amount of 24 to 26% by weight, based on the total weight of the cathode, and the third polymer is present in an amount of 7 to 15% by weight, based on the total weight of the anode.

The present invention also provides a water electrolysis cell including the membrane electrode assembly for water electrolysis.

Preparative Examples 1-4. Preparation of Polymers Having No Aryl Ether Linkages and Containing Piperidinium Groups and Phenyl-Based Blocks Introduced Therein and Anion Exchange Membranes Using the Polymers Reaction Scheme 1 shows the preparation of copolymers in Preparative Examples 1-4.

[Reaction Scheme 1]

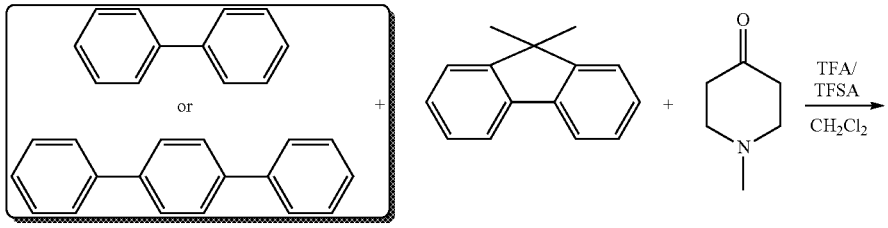

-continued
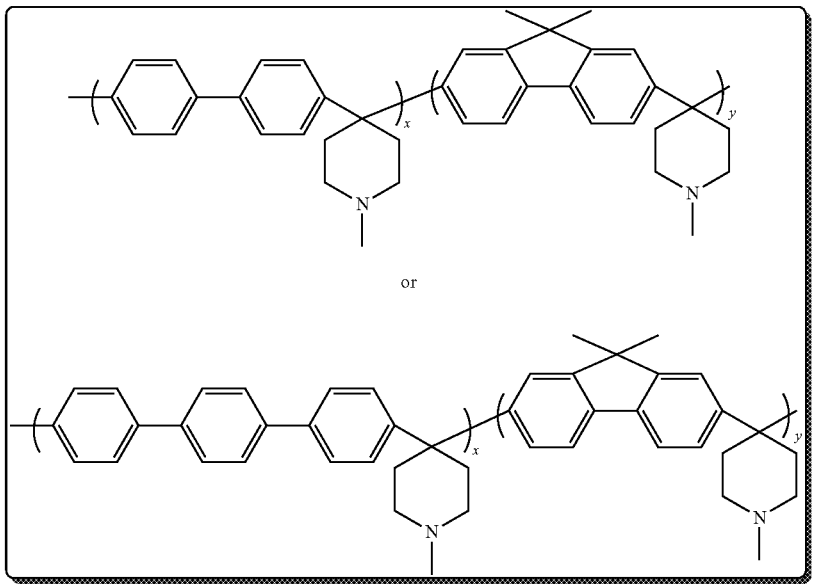
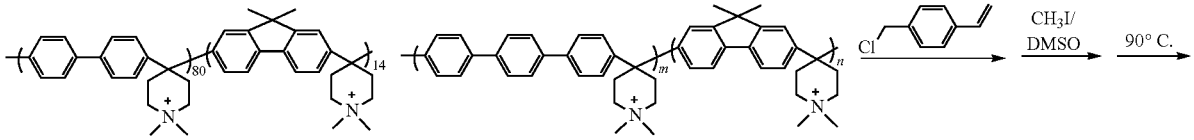
PFBP-14
PFTP-n; PFTP-8 and PFTP-13
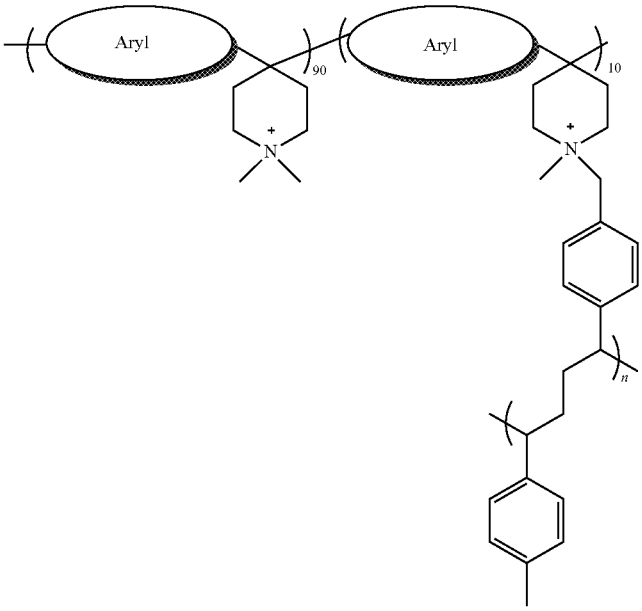
x-PFTP
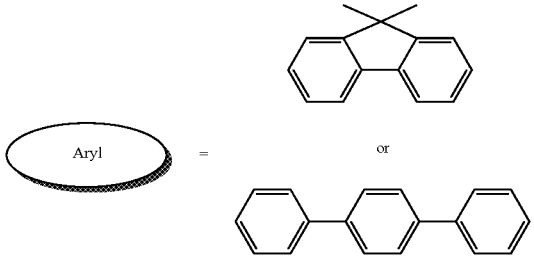

Preparative Example 1. PFTP-8

Preparation of poly(fluorenyl-co-terphenyl piperidinium-8)

Terphenyl (2.233 g, 1.2 mmol), 9,9'-dimethylfluorene (3.174 g, 13.8 mmol), and 1-methyl-4-piperidone (1.919 mL, 16.5 mmol) were placed in a three-necked flask, and then dichloromethane ($CH_2Cl_2$, 12 mL) was added thereto. The mixture was stirred to dissolve the monomers and purged with nitrogen for 10 min. Then, the monomer solution was cooled to −3° C. and trifluoroacetic acid (TFA, 1.8 mL) and trifluoromethanesulfonic acid (TFSA, 12 mL) were slowly added thereto. Immediately after the TFSA addition, 10 the solution turned dark red in color. The dark red solution was mechanically stirred at an RH of ~10% for 8 h and the reaction was maintained at −3° C. Thereafter, the viscous polymer solution was poured into a 1 M NaOH solution to prepare a white viscous polymer. The polymer was crushed with a blender and washed several times with deionized water until neutrality. Then, the polymer was dried in a vacuum oven at 80° C. to prepare pale yellow poly(fluorene-co-terphenyl N-methylpiperidine) (PFTM).

Then, 4 g of PFTM was dissolved in a mixture of 40 mL of DMSO and 1 mL of TFA as a cosolvent at 80° C. and cooled to room temperature. To the solution were added 2.5 g of potassium carbonate and 2 mL of $CH_3I$ (3 eq.). The mixture was covered with silver foil to avoid light and subjected to a quaternization reaction for 24 h. After completion of the reaction, the polymer solution was precipitated in ethyl acetate. The resulting polymer was filtered twice with deionized water to remove residual inorganic salts. Finally, the polymer was dried in a vacuum oven at 80° C. for 24 h to prepare 4.8 g of white PFTP-8.

The repeating unit of PFTP-8 prepared in Preparative Example 1 is represented by Formula 9:

(9)

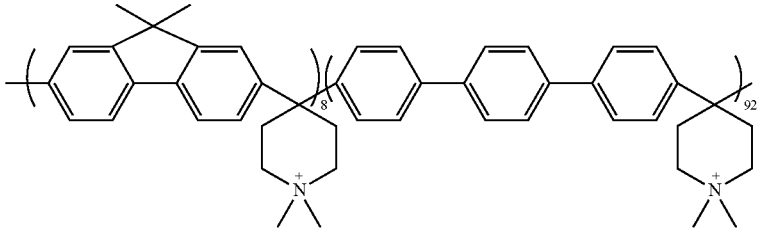

Preparation of Anion Exchange Membrane 1 g of PFTP-8 was dissolved in 29 g of DMSO. Then, the solution containing 3.33 wt % of PFTP-8 was put into a syringe, filtered through a 0.45 μm filter, cast on a glass plate (14×21 cm), dried in an oven at 90° C. for 24 h to slowly remove the solvent, and dried in a vacuum at 140° C. for 12 h to completely remove the solvent. Then, the resulting membrane was immersed in 1 M NaOH, 1 M NaCl, and 1 M $NaCO_3$ at 60° C. for 24 h for ion exchange with OH, Cl, and $CO_3^{2-}$, respectively, to prepare a PFTP-8 anion exchange membrane having a thickness of ~40 μm.

Preparative Example 2. PFTP-13

Preparation of poly(fluorenyl-co-terphenyl piperidinium-13)

PFTP-13 and an anion exchange membrane using PFTP-13 were prepared in the same manner as in Preparative Example 1, except that terphenyl (8.28 g, 36 mmol), 9,9'-dimethylfluorene (0.777 g, 4 mmol), and 1-methyl-4-piperidone (5.12 mL, 44 mmol) were placed in a three-necked flask.

The repeating unit of PFTP-13 prepared in Preparative Example 2 is represented by Formula 10:

(10)

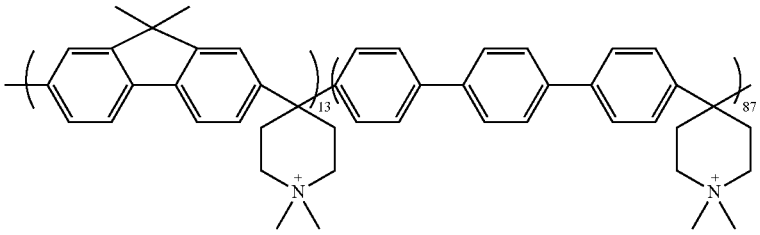

Preparative Example 3. PFBP-14

Preparation of (poly(fluorenyl-co-biphenyl piperidinium-14))

Poly(fluorene-co-biphenyl N-methylpiperidine) (PFBM) and a PFBP-14 anion exchange membrane using PFBM were prepared in the same manner as in Preparative Example 1, except that biphenyl (4.158 g, 27 mmol), 9,9'-dimethylfluorene (0.5828 g, 3 mmol), 1-methyl-4-piperidone (3.838 mL, 33 mmol), and dichloromethane (24 mL) were placed in a three-necked flask.

The repeating unit of PFBP-14 prepared in Preparative Example 3 is represented by Formula 11:

(11)

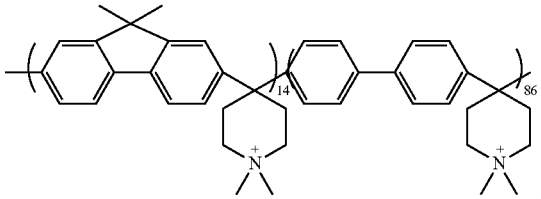

The intrinsic viscosities of PFTP-8 (Preparative Example 1), PFTP-13 (Preparative Example 2), and PFBP-14 (Preparative Example 3) were 4.01 dL/g, 3.34 dL/g, and 2.23 dL/g, respectively.

Preparative Example 4. x-PFTP

PFTM (4 g, 6 mmol) prepared in Preparative Example 1 and TFA (0.64 mL, 8.63 mmol) were dissolved in 80 mL of DMSO and placed in a 250 mL flask equipped with a magnetic bar. To the solution were added $K_2CO_3$ (2.98 g, 21.57 mmol) and vinylbenzyl chloride (VBC) (0.092 g, 0.6 mmol). The mixture was stirred at room temperature for 24 h. To the mixture was added $CH_3I$ (3.058 g, 21.55 mmol). Stirring was continued for 24 h for quaternization. After completion of the reaction, the polymer solution was precipitated in ethyl acetate. The resulting polymer was filtered twice with deionized water to remove residual inorganic salts. Finally, the polymer was dried in a vacuum oven at 60° C. for 24 h to prepare x-PFTP having a degree of crosslinking of 10%. An anion exchange membrane using x-PFTP was prepared in the same manner as in Preparative Example 1.

Preparation 5. PDTP-25

Preparation of poly(diphenyl-co-terphenyl dimethyl piperidinium-25)

Diphenylethane (1.0252 g, 5.625 mmol), terphenyl (3.885 g, 16.857 mmol), and 1-methyl-4-piperidone (2.8005 g, 24.750 mmol) as monomers were placed in a 100 mL reactor, and then dichloromethane (18 mL) was added thereto. The mixture was stirred to dissolve the monomers. The solution was cooled to 1° C. To the solution was slowly added a mixture of trifluoroacetic acid (2.7 mL) and trifluoromethanesulfonic acid (18 mL). The reaction was allowed to proceed with stirring for 12 h to obtain a viscous solution. The viscous solution was poured into 500 mL of distilled water for precipitation, washed several times with deionized water, and dried in an oven at 70° C. for 24 h to prepare poly(diphenyl-co-terphenyl N-methyl piperidine) (yield 95.3%) as a solid. The polymer was named "PDTM-25".

Next, PDTM-25 (6.0 g, 12.9 mmol) was dissolved in dimethyl sulfoxide (100 mL). To the polymer solution were added $K_2CO_3$ (3.6 g, 25.8 mmol) and iodomethane (5.5 g, 38.7 mmol). The mixture was allowed to react at room temperature in the dark. for 24 h to form a quaternary piperidinium salt. Next, the polymer solution was precipitated in 800 mL of ethyl acetate, filtered, washed several times with deionized water, and dried in a vacuum oven at 70° C. for 24 h to prepare poly(diphenyl-co-terphenyl dimethyl piperidinium) as a solid (yield 88%). The polymer ionomer was named "PDTP-25".

Preparation of Anion Exchange Membrane

An anion exchange membrane was prepared in the same manner as in Preparative Example 1, except that 1.25 g of PDTP-25 was dissolved in DMSO to prepare a solution containing 4 wt % of PDTP-25 and the solution was cast on a glass plate (13×22 cm). The thickness of the PDTP-25 anion exchange membrane was ~20-25 μm.

The chemical structure of PDTP-25 prepared in Preparative Example 5 is represented by Formula 12:

(12)

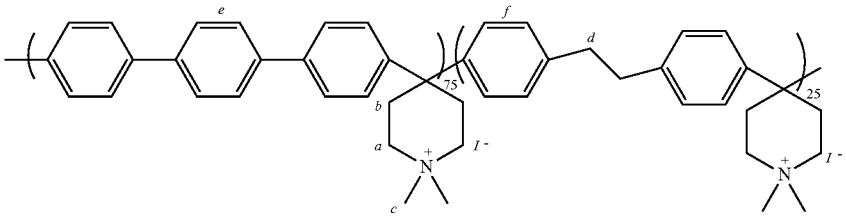

Example 1. PGM Membrane Electrode Assembly

Catalyst Ink Preparation $IrO_2$ (Alfa Aesar, MA, USA) and 46.6% Pt/C (TANAKA Co., Japan) were used as anode and cathode catalysts, respectively, for anion exchange membrane water electrolyzers.

An anode catalyst ink was prepared as follows: 100 mg of $IrO_2$ powder was suspended in 1 g of deionized water, 2 g of isopropyl alcohol (IPA; Baker Analyzed HPLC Reagent), and 0.22 g of an ionomer solution of 5 wt % PFTP-8 ionomer in DMSO. The loading of the $IrO_2$ catalyst was 2.0 mg/cm$^2$, and the anode PFTP-8 ionomer content was 10 wt %.

A cathode catalyst ink was prepared as follows: 100 mg of 46.6% Pt/C powder was suspended in 0.5 g of deionized water, 1 g of isopropyl alcohol (Baker Analyzed HPLC Reagent, IPA), and 0.5 g of an ionomer solution of 5 wt % PFBP-14 ionomer in DMSO. The loading of the Pt/C catalyst was 0.5 mg/cm$^2$, and the cathode PFBP-14 ionomer content was 20 wt %.

Fabrication of Membrane Electrode Assembly and Manufacture of Water Electrolysis Cell The above inks were sonicated for 1 h before membrane electrode assembly preparation. Meanwhile, the PFTP-8 anion exchange membrane was immersed in 6 M KOH solution for 1 h and then rinsed with 1 M KOH solution for 1 h. Subsequently, the catalyst inks were sprayed on both sides of the PFTP membrane to prepare a catalyst-coated membrane (CCM) using a hand spray system. The CCM was dried at room temperature for 24 h. Titanium felt (Bakaert, Belgium) and carbon paper (Sigracet 39 BC, SGL carbon, Germany) were used as anode and cathode gas diffusion layers (GDL), respectively. Finally, a single anion exchange membrane water electrolysis cell was assembled by placing the CCM and two GDLs between gold-plated titanium (A) and graphite bipolar (C) plates with a torque of 60 in-lb. The active electrode area of the cell was 6.25 cm$^2$ (2.5 cm×2.5 cm).

Example 2. PGM Membrane Electrode Assembly

A membrane electrode assembly was fabricated and a water electrolysis cell was manufactured in the same manner as in Example 1, except that the content of the PFBP-14 ionomer of Preparative Example 3 was increased to 25 wt %, based on the total weight of the cathode, to prepare a cathode catalyst ink.

Example 3. PGM Membrane Electrode Assembly

A membrane electrode assembly was fabricated and a water electrolysis cell was manufactured in the same manner as in Example 1, except that the content of the PFBP-14 ionomer of Preparative Example 3 was increased to 30 wt %, based on the total weight of the cathode, to prepare a cathode catalyst ink.

Example 4. PGM Membrane Electrode Assembly

A membrane electrode assembly was fabricated and a water electrolysis cell was manufactured in the same manner as in Example 2, except that the PFTP-13 anion exchange membrane of Preparative Example 2 was used instead of the PFTP-8 anion exchange membrane of Preparative Example 1.

Example 5. PGM Membrane Electrode Assembly

A membrane electrode assembly was fabricated and a water electrolysis cell was manufactured in the same manner as in Example 2, except that the x-PFTP anion exchange membrane of Preparative Example 4 was used instead of the PFTP-8 anion exchange membrane of Preparative Example 1.

Example 6. PGM Membrane Electrode Assembly

A membrane electrode assembly was fabricated and a water electrolysis cell was manufactured in the same manner as in Example 2, except that the PDTP-25 anion exchange membrane of Preparative Example 5 was used instead of the PFTP-8 anion exchange membrane of Preparative Example 1 and stainless felt (Dioxide Materials, FL, USA) and nickel paper (Dioxide Materials, FL, USA) were used as anode and cathode gas diffusion layers (GDL).

Example 7. PGM-Free Membrane Electrode Assembly

A PGM-free membrane electrode assembly was fabricated using a catalyst-coated substrate (CCS) method based on A/C Raney Ni—Fe catalyst without ionomers.

Ni—Fe Electrode Preparation

Ni foam (Alantum, Germany) was pretreated with 30 wt % sodium hydroxide (NaOH) aqueous solution at 90° C. for 3 min and sonicated in 20 wt % hydrochloric acid (HCl) aqueous solution at room temperature for 10 min to remove organic impurities. The Ni foam was treated anodically at room temperature in 70 wt % sulfuric acid ($H_2SO_4$) (Dae-Jung, South Korea) for 3 min at 100 mA/cm$^2$ to remove the $NiO_2$ passivation film. Next, strike plating was performed using the Wood's Bath formulation (240 g/L $NiCl_2 \cdot 6H_2O$ (Wako, Japan), 120 mL/L 35 wt % HCl (Dae-Jung, South Korea)) at 25 mA/cm$^2$ for 5 min to form a thin Ni adhesive layer that serves as a base for subsequent electrodeposition on the Ni foam surface. After each process, the Ni foam was rinsed with deionized water. To increase the catalytic activity of the Raney Ni—Fe electrode and decrease the overvoltage of the oxygen evolution reaction, the Ni—Zn—Fe alloy was electrodeposited on the Ni foam and Zn was removed selectively to prepare an electrode with an improved specific surface area. Electrodeposition on the prepared Ni foam substrate was performed using a thermostat-controlled Pyrex glass bath at 50° C. to fix the two-electrode system (working electrode, Ni foam; counter electrode, Ni plate). The electrodeposition of Ni, Fe, and Zn was accomplished using a modified Watts bath solution (37.5 g/L $H_3BO_3$, 330 g/L $NiSO_4 \cdot 6H_2O$, 45 g/L $NiCl_2 \cdot 6H_2O$, 20 g/L $ZnCl_2$, and 30 g/L $FeSO_4 \cdot 7H_2O$) through a DC Power Supply (XG 20-76 (AMETEK, Inc., PA, USA)). The Zn component of the Ni—Zn—Fe alloy was leached selectively by treatment with 30 wt % KOH and a 10 wt % $KNaC_4H_4O_6 \cdot 4H_2O$ (Sigma-Aldrich, MO, USA) solution at 80° C. for 24 h. To remove Ni—H from the Zn leaching process, the Ni—Fe electrodeposited electrode was immersed in 15 wt % $H_2O_2$ (Dae-Jung, South Korea) at room temperature and stored until bubbles were no longer generated. Subsequently, the Ni—Fe electrodeposited electrode was washed with deionized water and dried in a vacuum desiccator.

Fabrication of PGM-Free Membrane Electrode Assembly

Then, the PFTP-13 anion exchange membrane of Preparative Example 2 was treated with KOH and the two Ni—Fe electrodes were assembled directly onto the KOH-treated anion exchange membrane. The catalyst load of A/C Ni—Fe was 20 mg/cm$^2$.

Comparative Example 1. PGM Membrane Electrode Assembly

A PGM membrane electrode assembly was fabricated in the same manner as in Example 2, except that 10 wt % PTFE was used as the anode ionomer.

Comparative Example 2. PGM Membrane Electrode Assembly

A PGM membrane electrode assembly was fabricated in the same manner as in Comparative Example 1, except that Sustainion® AEM (X37-50 grade T, Dioxide Materials, FL, USA) was used as the anion exchange membrane.

Comparative Example 3. PGM Membrane Electrode Assembly

A PGM membrane electrode assembly was fabricated in the same manner as in Comparative Example 2, except that Sustainion® XA-9 ionomer (Dioxide Materials, FL, USA) as the cathode ionomer was used in an amount of 10 wt %, based on the total weight of the cathode.

Comparative Example 4. PGM-Free Membrane Electrode Assembly

A PGM-free membrane electrode assembly was fabricated in the same manner as in Example 7, except that PTFE-reinforced Sustainion® was used instead of the PFTP-13 anion exchange membrane of Preparative Example 2.

Table 1 shows the membrane electrode assemblies fabricated in Examples 1-7 and Comparative Examples 1-4.

TABLE 1

| Example No. | Anion exchange membrane | Anode ionomer | Cathode ionomer | Anode catalyst | Cathode catalyst |
|---|---|---|---|---|---|
| Example 1 | | | Preparative Example 3 (PFBP-14) 20 wt % | | |
| Example 2 | Preparative Example 1 (PFTP-8) | | Preparative Example 3 (PFBP-14) 25 wt % | | |
| Example 3 | | | Preparative Example 3 (PFBP-14) 30 wt % | $IrO_2$ 2 mg/cm$^2$ | Pt/C 0.5 mg/cm$^2$ |
| Example 4 | Preparative Example 2 (PFTP-13) | Preparative Example 1 (PFTP-8) 10 wt % | | | |
| Example 5 | Preparative Example 4 (x-PFTP) | | Preparative Example 3 (PFBP-14) 25 wt % | | |
| Example 6 | Preparative Example 1 (PDTP-25) | | Preparative Example 3 (PFBP-14) 25 wt % | | |
| Example 7 | Preparative Example 2 (PFTP-13) | — | — | Ni—Fe 20 mg/cm$^2$ | |
| Comparative Example 1 | Preparative Example 1 (PFTP-8) | PTFE 10 wt % | Preparative Example 3 (PFBP-14) 25 wt % | | |
| Comparative Example 2 | PTFE-reinforced Sustainion ® | PTFE 10 wt % | Preparative Example 3 (PFBP-14) 25 wt % | $IrO_2$ 2 mg/cm$^2$ | Pt/C 0.5 mg/cm$^2$ |
| Comparative Example 3 | PTFE-reinforced Sustainion ® | PTFE 10 wt % | Sustainion ® XA-9 10 wt % | | |
| Comparative Example 4 | PTFE-reinforced Sustainion ® | — | — | Ni—Fe 20 mg/cm$^2$ | |

EXPERIMENTAL EXAMPLES

Instrumental Analysis and Test Methods

1. Dynamic Vapor Sorption (DVS) and Water Diffusivity

The water sorption of dried anion exchange membranes ($HCO_3^-$ form) of Examples 1-7 and Comparative Examples 1~4 was measured using a dynamic vapor sorption (DVS; Surface Measurement Systems, UK) instrument at different RH values (0%, 15%, 30%, 45%, 60%, 75%, and 90%) and 25° C. Every RH stage was held for 1 hour to achieve equilibrium. The water diffusivity of the anion exchange membranes was calculated automatically at every RH stage using DVS-bundled Excel software based on the DVS results.

2. Physical Properties

The ion exchange capacity (IEC), water uptake (WU), swelling ratio (SR), and OH conductivity of the anion exchange membranes were measured according to suitable methods known in the art.

The ion exchange capacity values of the polymers were calculated by 1H NMR through the relative integral area between the aromatic and methyl protons. The water uptake (WU) and swelling ratio (SR) of membranes were measured in $OH^-$ and $Cl^-$ forms.

After ion exchange, a membrane in a specific form was washed with deionized water several times, and then the hydrated membrane was wiped quickly using a filter paper to remove the surface water. The weight ($m_{wet}$) and unidirectional length ($L_{wet}$) of the wet membrane were recorded. Then, the membrane was dried in a vacuum oven to constant weight by covering it with a filter paper to avoid membrane shrinkage. Subsequently, the dry weight ($m_{dry}$) and the length ($L_{dry}$) of the membrane were recorded immediately. In-plane and through-plane swelling ratios (SR) were measured. Water uptake (WU) and swelling ratio (SR) were calculated according to Equations (1) and (2), respectively:

$$WU(\%) = [(m_{wet} - m_{dry})/m_{dry} \times 100 \quad (1)$$

$$SR(\%) = [(L_{wet} - L_{dry})/L_{dry} \times 100 \quad (2)$$

The ion conductivity of ionomers was measured using a four-probe method by an AC impedance analyzer (VSP and VMP3 Booster, Bio-Logic SAS, Grenoble, France) over the frequency range from 0.1 to 100 kHz. All membrane samples in different forms were cut into 1×3 cm rectangular shapes (width=1 cm), and then the membranes were fixed between two Pt wire electrodes in a fuel cell test station (CNL, Energy Co., Seoul, Korea). The distance (L) between the two electrolytes was 1 cm. The thickness (d) of the membrane sample was measured using a micrometer caliper. In-plane ion conductivity ($\sigma$) was measured at fully hydrated conditions (RH=100%) at elevated temperatures, and the resistance (R) of the membrane was recorded. The ion conductivity was calculated from Equation (3):

$$\sigma = d/RLW \quad (3)$$

Hydration number ($\lambda$), which represents the number of water molecular per $OH^-$, was calculated using Equation (4):

$$\lambda = W_U \times 10/IEC \times 18 \quad (4)$$

3. Measurement of Performance of Anion Exchange Membrane Water Electrolyzers

To produce high-purity hydrogen, anhydrous cathode anion exchange membrane water electrolyzers were run by feeding 1 M KOH solution into the anode at a flow rate of 15-35 mL/min. The I-V curves of the anion exchange membrane water electrolyzers were recorded at 45° C., 60° C. or 80° C. by scanning the cell voltage at a rate of 10 mV/s using a potentiostat (Bio-Logic HCP-803 with EC-lab software (Knoxville, TN, USA)). EIS analysis (Bio-Logic HCP-803 with EC-lab software (Knoxville, TN, USA)) was monitored at 1.6 V with an amplitude of 16 mV in the frequency range of 50 mHz to 50 kHz.

For pure water conditions, the aforementioned anion exchange membrane water electrolyzers were washed with Milli-Q deionized water and purged with ~50 mL of deionized water for cell performance measurement.

The in situ durability of the PGM and PGM-free anion exchange membrane water electrolyzers was measured at constant current density values of 0.5 A/cm$^2$ and 1 A/cm$^2$ at 60° C. Moreover, the high frequency resistance (HFR) of the cells was recorded via EIS analysis using a potentiostat/galvanostat (Bio-Logic HCP-803 with EC-lab software (Knoxville, TN, USA)) with a booster at a constant current of 0.5 A/cm$^2$ prior to single-cell durability measurements.

Experimental Example 1. Analysis of Physical Properties of the Anion Exchange Membranes FIG. 1 is a schematic diagram of a water electrolytic cell without water-feeding electrodes. The water supply of the dried cathode stems completely from the anode side by water diffusion in the water electrolysis cell shown in FIG. 1, unlike in a common anion exchange membrane water electrolyzer. Since this water diffusion depends on the OH-conductivity and water diffusivity ($D_w$) of the anion exchange membrane constituting the membrane electrode assembly of the water electrolysis cell, the OH conductivity and water diffusivity ($D_w$) of the anion exchange membrane are crucial. In addition, since the cathode of the membrane electrode assembly is required to quickly catch diffusing water, high IEC, water uptake, and water diffusivity of the water uptake are required. The physical properties of the anion exchange membranes of Preparative Examples 1-4 and commercial anion exchange membranes were measured. The results are shown in Tables 1 and 2.

Figure 2A:
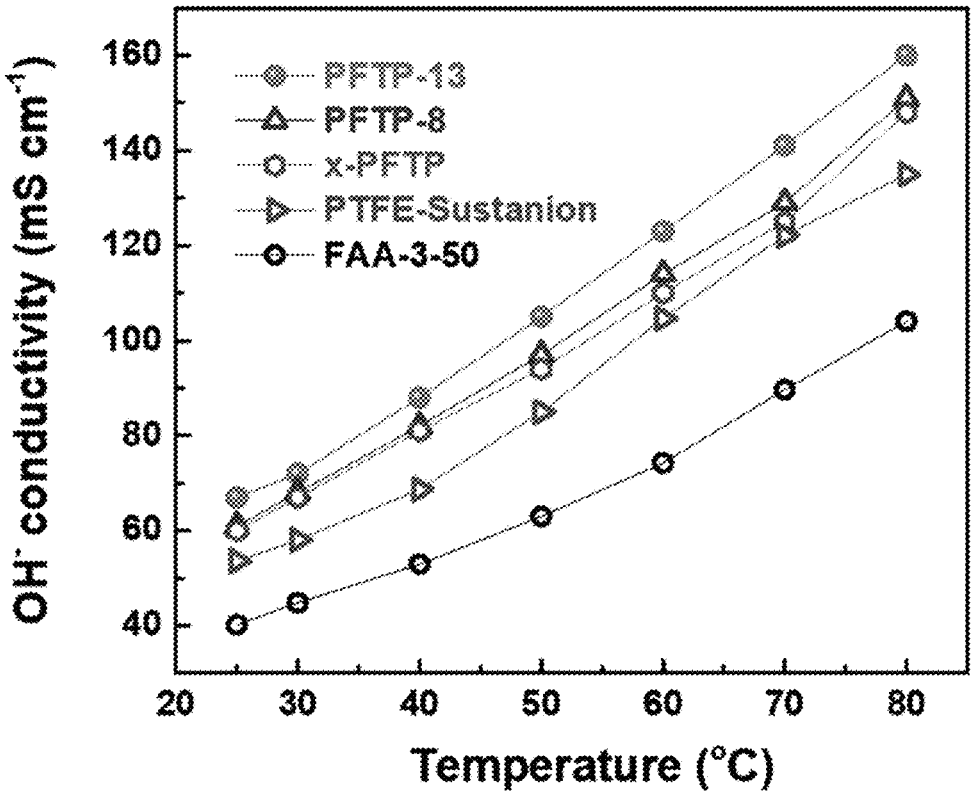
FIGS. 2A and 2B, respectively, show OH-conductivities and mechanical properties of anion exchange membranes prepared in Preparative Examples 1, 2, and 4 and commercial anion exchange membranes over time.
Figure 2B:
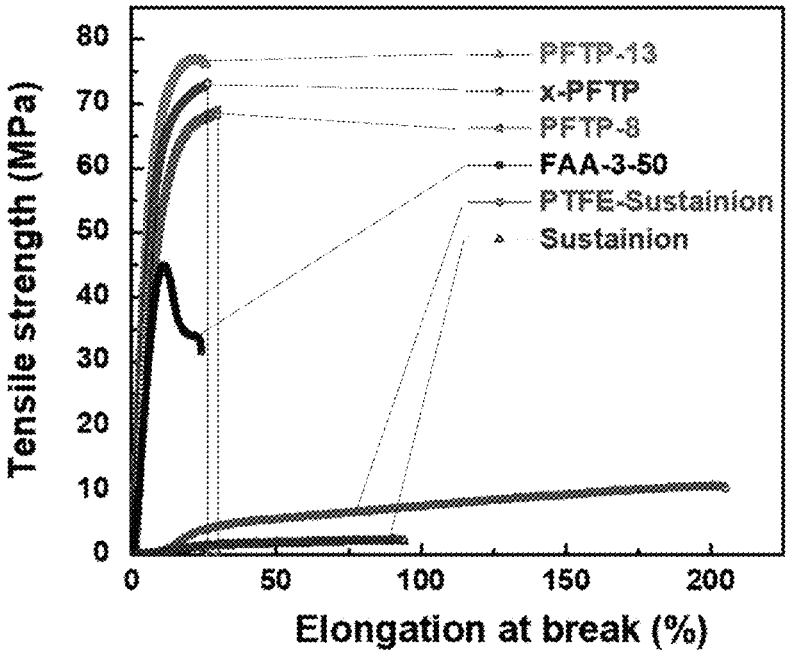

FIGS. 2A and 2B, respectively, show $OH^-$ conductivities and mechanical properties of the anion exchange membranes of Preparative Examples 1, 2, and 4 and commercial anion exchange membranes over time.

Referring to FIG. 1 and Table 2, the OH conductivities of the anion exchange membranes of Preparative Examples 1~4 were higher than those of the commercial anion exchange membranes. In addition, the commercial Sustanion anion exchange membranes displayed a poor mechanical strength and a limited dimensional stability compared to the PFTP anion exchange membranes, becoming brittle and wrinkled in the dry state. The Sustanion® anion exchange membrane without PTFE reinforcement is difficult to handle and use due to its very poor mechanical properties in the dry state.

TABLE 2

| Samples | IEC$^{(a)}$ (mmolg$^{-1}$) | WU$^{(a)}$ (%) | SR$^{(a)}$ (%) | $\sigma^{(b)}$ (mS cm$^{-1}$) | TS (MPa) | EB (%) | $D_w^{(c)}$ ($10^{-8}$ cm$^2$s$^{-1}$) |
|---|---|---|---|---|---|---|---|
| Preparative Example 1 (PFTP-8) | 2.80 | 95 | 29 | 151 | 63 | 45 | 5.03 |
| Preparative Example 2 (PFTP-13) | 2.82 | 73 | 23 | 163 | 71 | 25 | 9.08 |

TABLE 2-continued

| Samples | IEC[a] ($mmolg^{-1}$) | WU[a] (%) | SR[a] (%) | σ[b] ($mS\ cm^{-1}$) | TS (MPa) | EB (%) | $D_w$[c] ($10^{-8}\ cm^2s^{-1}$) |
|---|---|---|---|---|---|---|---|
| Preparative Example 3 (PFBP-14) | 3.43 | 355 | 122 | 146 | 40 | 21 | 11.2 |
| Preparative Example 4 (x-PFTP) | 2.73 | 74 | 21 | 149 | 72 | 41 | 2.35 |
| Sustainion AEMs ® | — | x | x | x | 2.29 | 94.4 | x |
| PTFE-reinforced Sustainion AEMs ® | — | 36 | 29 | 140 | 11 | 205 | 12.5 |
| FAA-3-50 | — | 66 | 36 | 110 | 45 | 24 | 4.70 |

[a]at 25° C.;
[b]$OH^-$ form at 80° C.;
[c]calculated at 0% RH by DVS;
x: too brittle to measure;
—: not measured;
TS: tensile strength;
EB: elongation at break.
The mechanical properties of Sustainion AEMs ® were measured in the wet state.

Experimental Example 2. Analysis of Impact of the Ionomers

Figure 3:
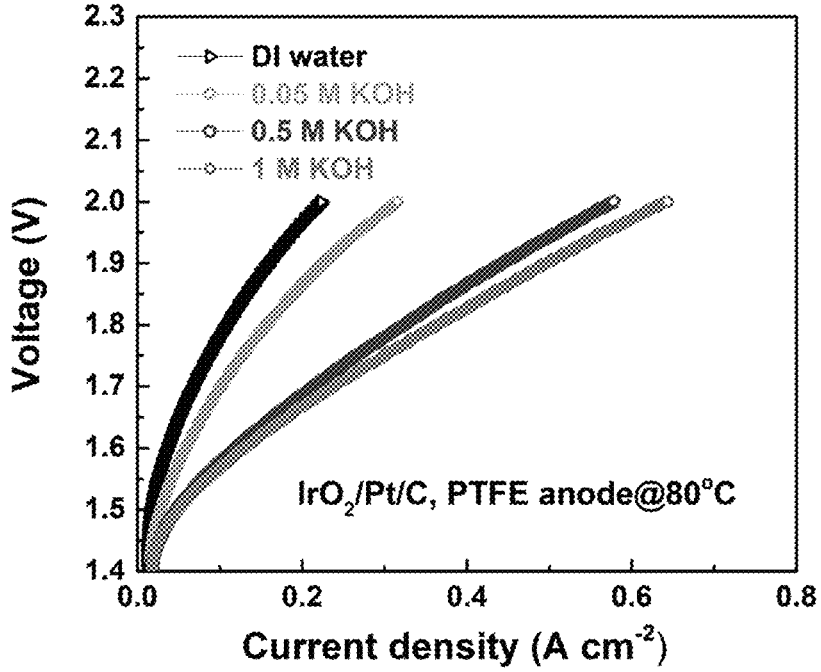
FIG. 3 shows the performance of a water electrolysis cell using a PGM membrane electrode assembly fabricated in Comparative Example 1.

FIG. 3 shows the performance of the water electrolysis cell using the PGM membrane electrode assembly fabricated in Comparative Example 1. Referring to FIG. 3, the PGM membrane electrode assembly fabricated in Comparative Example 1 displayed a poor current density under different KOH concentrations (–0.65 $A/cm^2$ in 1 M KOH at 80° C. and 2.0 V) due to the limited transport of OH through the PTFE binders.

In order to analyze water electrolysis performance depending on the ionomer concentration, a water electrolysis cell was manufactured using a PGM membrane electrode assembly using PFTP-8 prepared in Preparative Example 1 as an anode ionomer and an anion exchange membrane and PFBP-14 prepared in Preparative Example 3 as a cathode ionomer of the PGM membrane electrode assembly. The performance of the cell was measured by varying the content of PFBP-14. The results are shown in FIGS. 4A to 4D.

FIGS. 4A to 4D show I-V curves (FIG. 4A) and electrochemical impedance spectra (EIS) at 60° C. (FIG. 4B), and I-V curves (FIG. 4C) and electrochemical impedance spectra (EIS) at 80° C. (FIG. 4D) for the water electrolysis cells using the PGM membrane electrode assemblies fabricated in Examples 1 to 3.

Figure 4A:
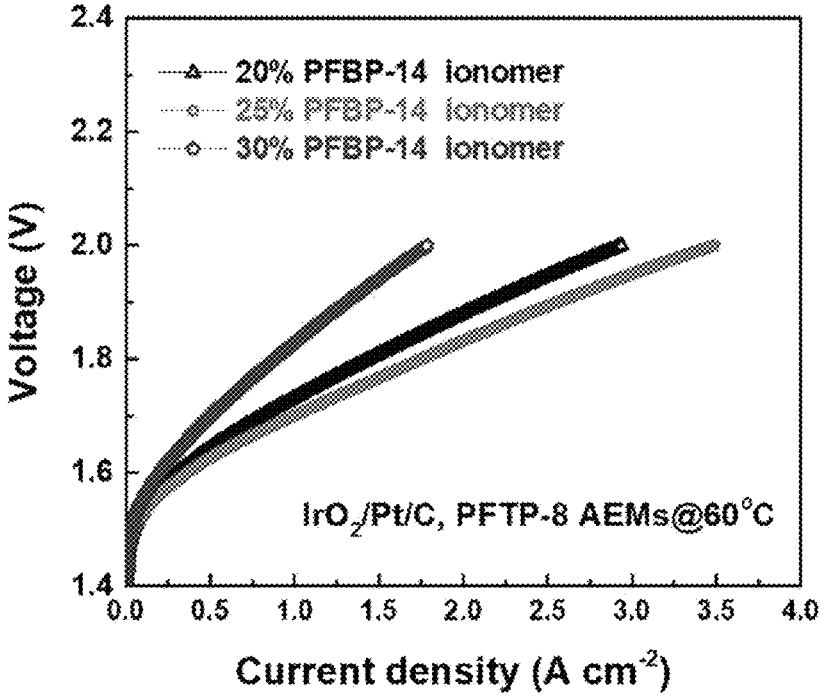
FIGS. 4A to 4D show I-V curves (FIG. 4A) and electrochemical impedance spectra (EIS) at 60° C.
Figure 4B:
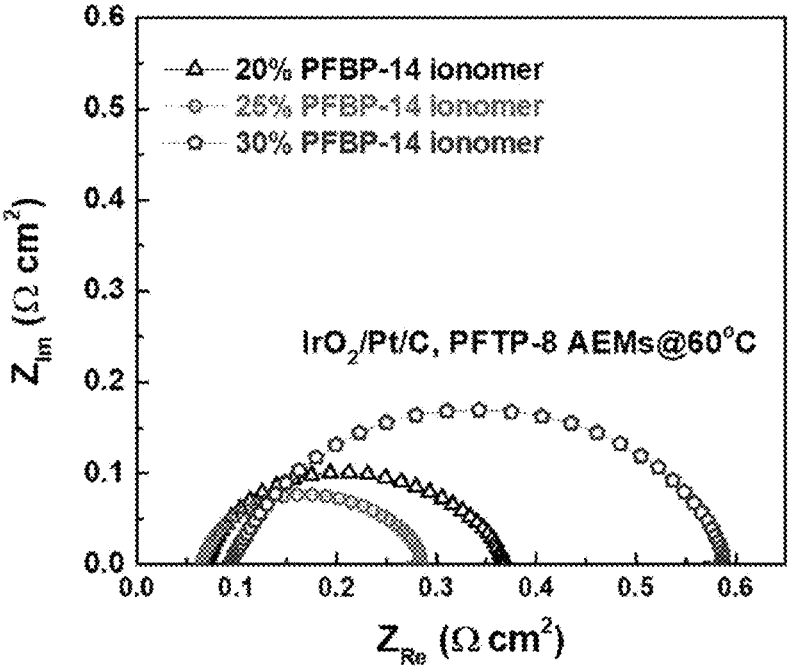

Referring to FIG. 4A, the current density of the water electrolysis cell was increased from ~2.8 $A/cm^2$ to ~3.5 $A/cm^2$ after increasing the cathode ionomer content from 20% (Example 1) to 25% (Example 2). Electrochemical impedance spectroscopy (EIS) FIG. 4B) indicated that the ohmic resistance ($R_{Ohm}$) of the cells was very similar (from 0.071 (2 $cm^2$ to 0.066 (2 $cm^2$), while the charge transfer resistance ($R_{CT}$) (from ~0.3 $O\Omega cm^2$ to ~0.21 (2 $cm^2$) was substantially decreased with an increase in the ionomer content. These results are because the increased secondary pore size of the catalyst layer improves the transportation of the reactants to catalytically active sites. However, the current density was significantly decreased to 1.75 $A/cm^2$ after further increasing the ionomer content to 30% (Example 3), along with a significant increase in the corresponding $R_{CT}$ (0.48 (2 $cm^2$). These results confirmed that the excess ionomer could block the active sites of the electrochemical catalyst and limit the electrochemical reaction to significantly improve the charge transfer resistance.

Figure 4C:
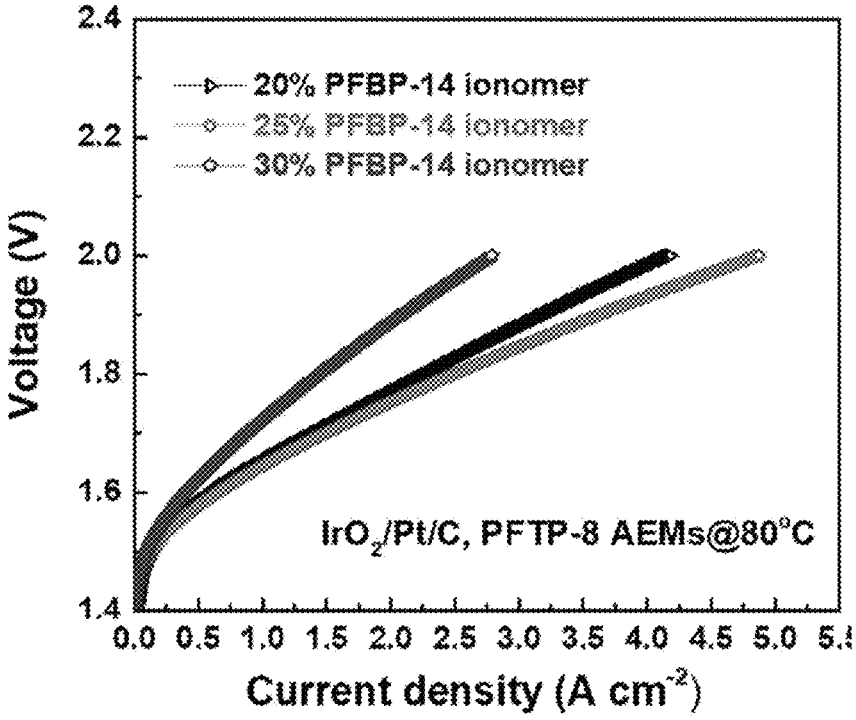
Figure 4D:
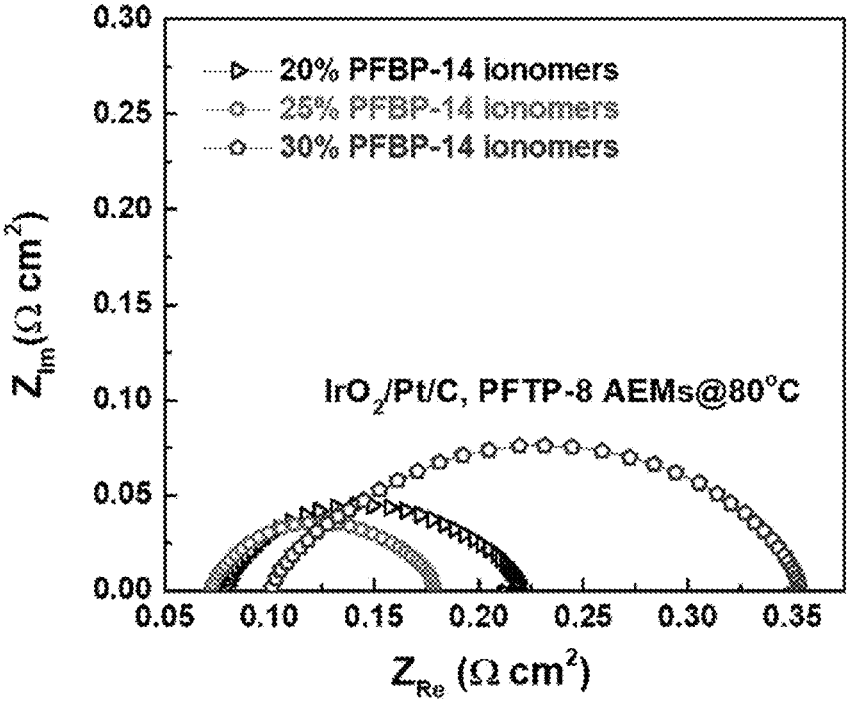

Referring to FIGS. 4C and 4D, after increasing the water electrolysis cell temperature to 80° C., the current densities of all the water electrolysis cells substantially improved along with an evident decrease in $R_{CT}$ due to the high electrode reactions and mass transport. Particularly, the water electrolysis cell using the PGM membrane electrode assembly reached a current density of 4.88 $A/cm^2$ at 2.0 V ($R_{Ohm}$: ~0.07 (2 $cm^2$; $R_{CT}$: ~0.1 (2 $cm^2$), confirming that the water electrolysis cell showed better performance than conventional anion exchange membrane water electrolyzers.

Experimental Example 3. Analysis of Water Electrolysis Performance According to Anion Exchange Membranes In order to analyze the water electrolysis performance of anion exchange membranes according to the water diffusivity of the anion exchange membranes, the performance of water electrolysis cells was measured according to different types of anion exchange membranes of membrane electrode assemblies using PFTP-8 prepared in Preparative Example 1 as an anode ionomer and PFBP-14 prepared in Preparative Example 3 as a cathode ionomer while feeding 1 M KOH. The results are shown in FIGS. 5 to 7.

Figure 5A:
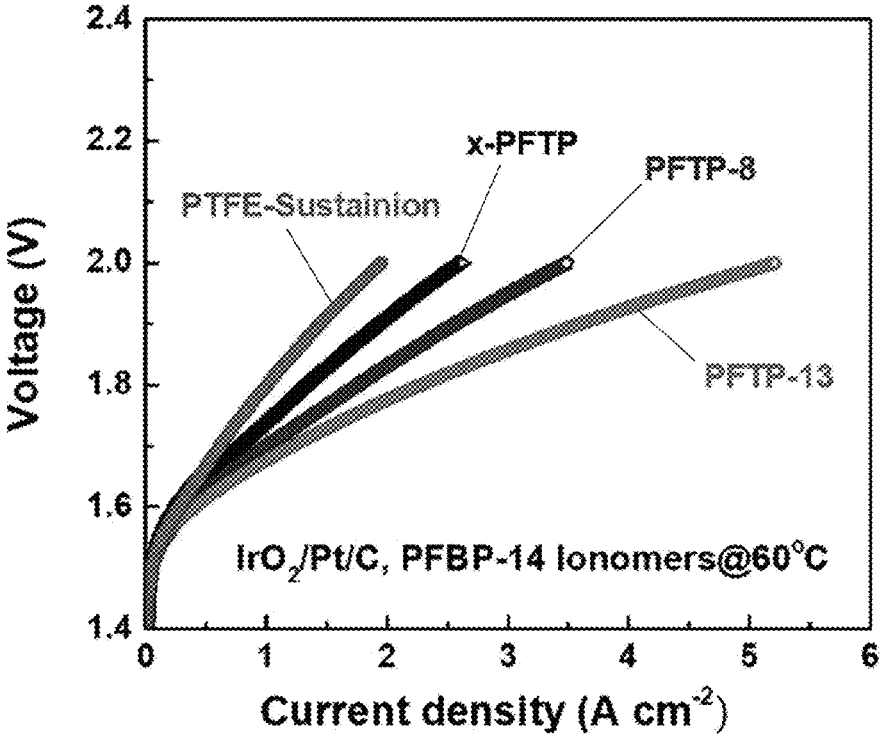
FIGS. 5A to 5C show I-V curves (FIG. 5A) and electrochemical impedance spectra (EIS) at 60° C.
Figure 5B:
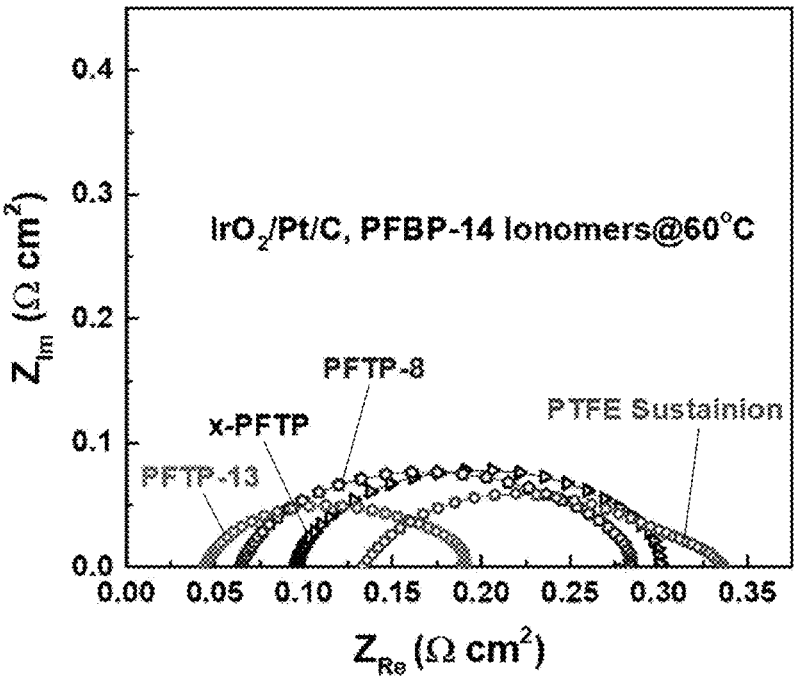
Figure 5C:
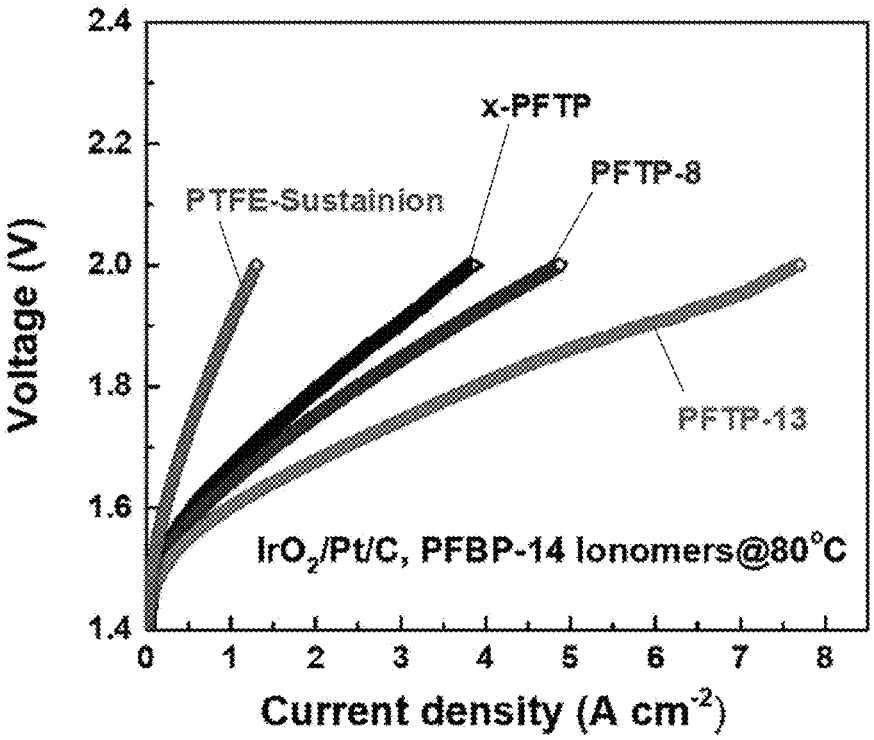

FIGS. 5A to 5C show I-V curves (FIG. 5A) and electrochemical impedance spectra (EIS) at 60° C. (FIG. 5B), and I-V curves at 80° C. (FIG. 5C) for water electrolysis cells using the PGM membrane electrode assemblies fabricated in Examples 2, 4, and 5, and Comparative Example 2.

Figure 6A:
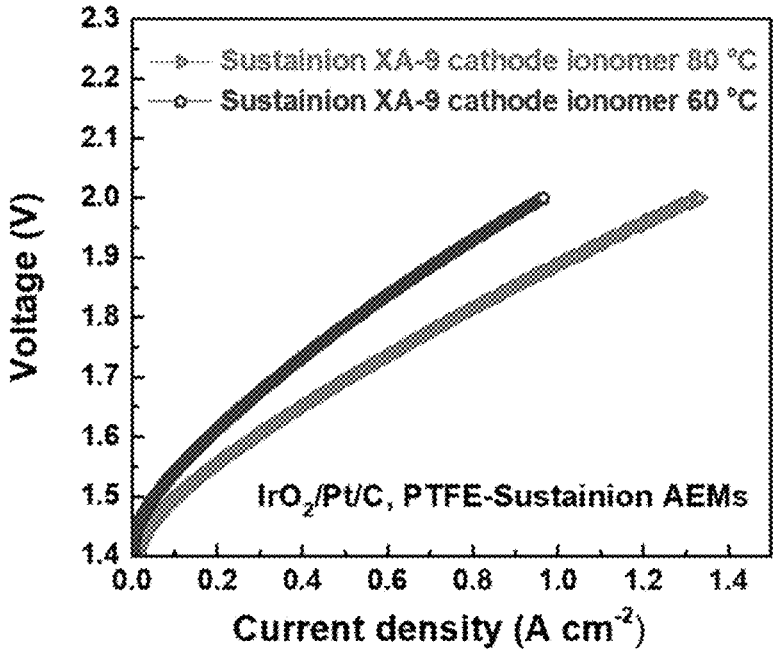
FIGS. 6A and 6B shows performance (FIG. 6A) and electrochemical impedance spectra (EIS) (FIG. 6B) of water electrolysis cells using a PGM membrane electrode assembly fabricated in Comparative Example 3.
Figure 6B:
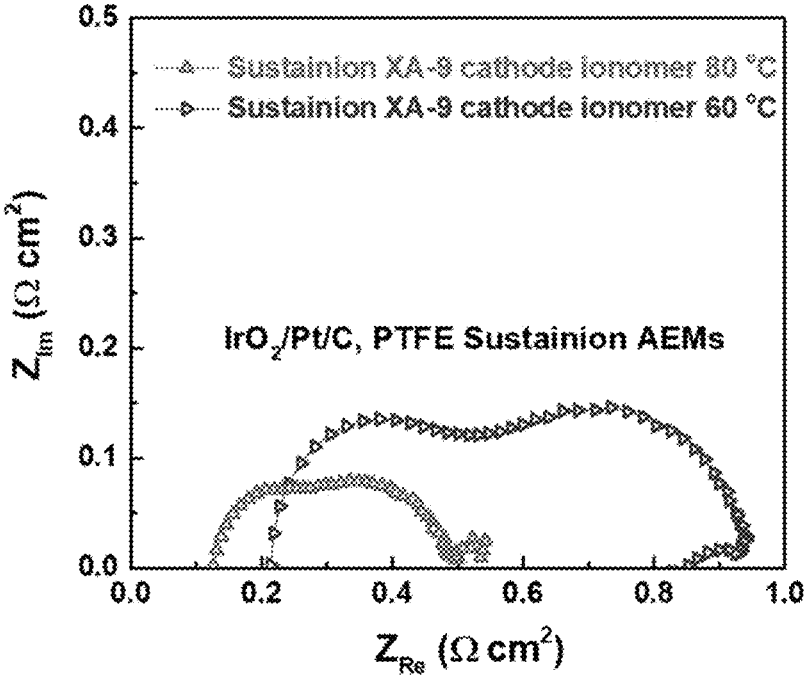

FIGS. 6A and 6B show performance and electrochemical impedance spectra (EIS) of water electrolysis cells using the PGM membrane electrode assembly fabricated in Comparative Example 3.

Figure 7:
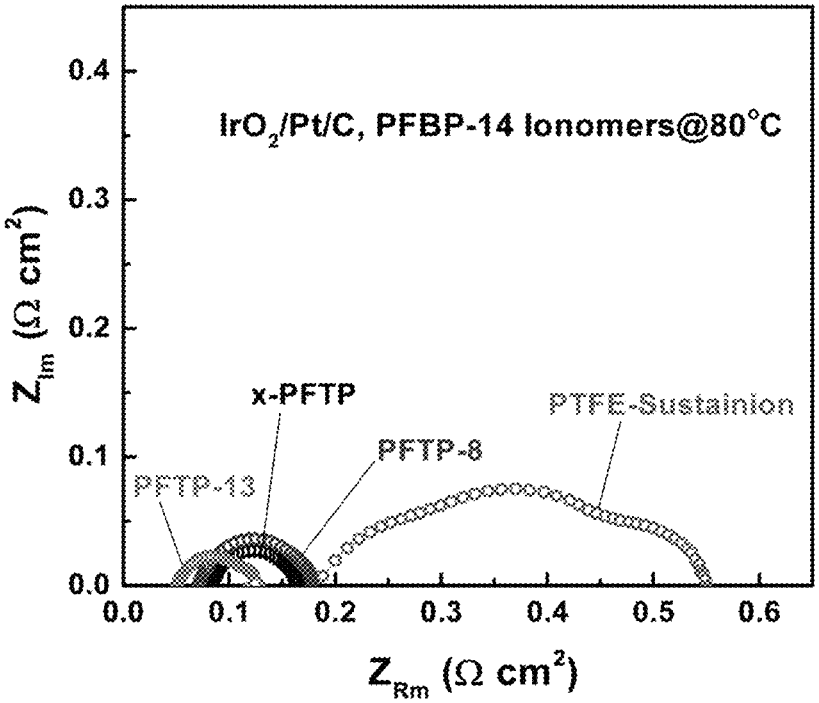
FIG. 7 shows electrochemical impedance spectra (EIS) of water electrolysis cells using PGM membrane electrode assemblies fabricated in Examples 2, 4, and 5 and Comparative Example 2, which were measured at 80° C.

FIG. 7 shows electrochemical impedance spectra (EIS) of water electrolysis cells using the PGM membrane electrode assemblies fabricated in Examples 2, 4, and 5 and Comparative Example 2, which were measured at 80° C.;

Referring to FIGS. 5A and 5B, the membrane electrode assembly of Example 4 using the PFTP-13 anion exchange membrane with high water diffusivity and ion conductivity displayed an outstanding current density of 5.2 $A/cm^2$ compared to the membrane electrode assemblies of Example 2 (3.5 $A/cm^2$) and Example 5 (2.4 $A/cm^2$). In addition, the membrane electrode assembly of Example 4 displayed a low $R_{ohm}$ (0.04 $\Omega cm^2$) and a low $R_{CT}$ (0.14 $\Omega cm^2$). Considering the similar ion conductivity, water uptake, and chemical structures of these anion exchange membranes used in Examples 2, 4, and 5, the current densities of the anion exchange membrane water electrolyzers are related positively to the water diffusivity, suggesting that the water diffusivity of the anion exchange membrane contributes to improving the water and OH transport in anion exchange membrane water electrolyzers. In contrast, referring to FIGS. 5 and 6, the anion exchange membrane water electrolyzers using the membrane electrode assemblies of Comparative Examples 2 and 3 displayed significantly low current densities of 1.8 A/cm$^2$ (much higher $R_{Ohm}$, 0.13 Ωcm$^2$; and $R_{CT}$, 0.2 Ωcm$^2$) and 1.3 A/cm$^2$, respectively.

Referring to FIG. 5C and FIG. 7, the current density of the anion exchange membrane water electrolyzer using the membrane electrode assembly of Example 4 was further improved to 7.68 A/cm$^2$ at 2.0 V and 80° C., along with low $R_{Ohm}$ (0.045 (2 cm$^2$) and $R_{CT}$ (0.07 Ωcm$^2$). This current density is much higher than that of state-of-the-art anion exchange membrane water electrolyzers reported so far (which are mostly below 4 A/cm$^2$ at 2.0 V) and exceeds that of state-of-the-art proton exchange membrane water electrolyzers (6 A/cm$^2$ at 2.0 V), demonstrating the superiority of the inventive membrane electrode assembly for water electrolysis.

Figure 8A:
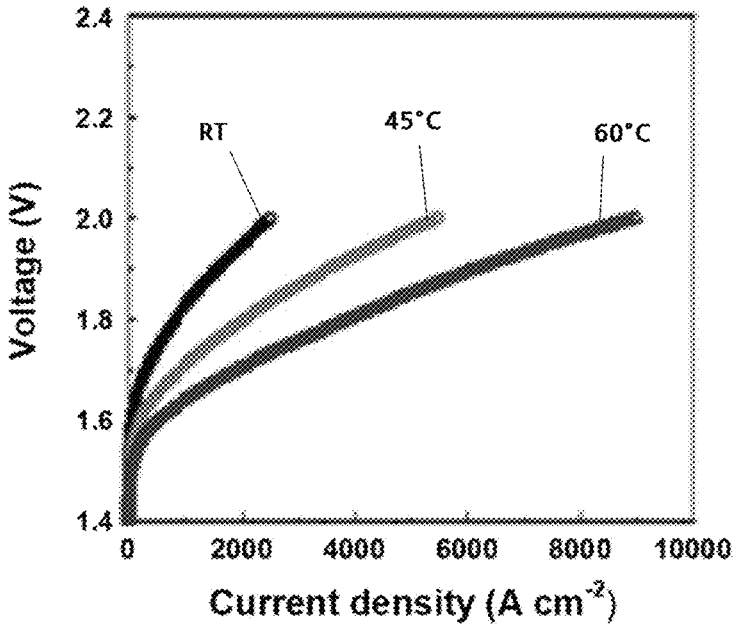
FIGS. 8A and 8B show I-V curves (FIG. 8A) and electrochemical impedance spectra (EIS) (FIG. 8B) at room temperature, 45° C., and 60° C. while feeding 1 M KOH. for a water electrolysis cell using a PGM membrane electrode assembly fabricated in Example 6.
Figure 8B:
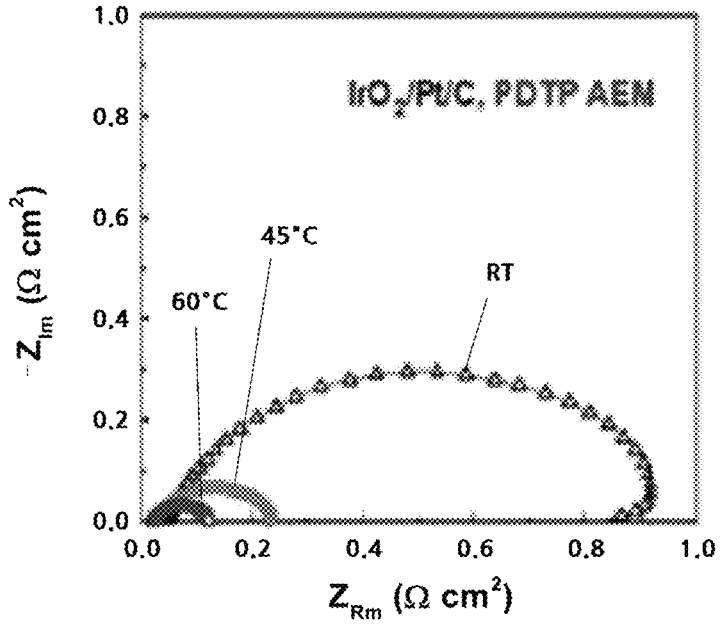

FIGS. 8A and 8B show I-V curves and electrochemical impedance spectra (EIS) at room temperature, 45° C., and 60° C. while feeding 1 M KOH for the water electrolysis cells using the PGM membrane electrode assembly fabricated in Example 6.

Referring to FIG. 8A, the water electrolysis cell using the PGM membrane electrode assembly of Example 6 reached current densities of 2.5 A/cm$^2$ (room temperature), 5.4 A/cm$^2$ (45° C.), and 8.9 A/cm$^2$ (60° C.) at 2.0 V in 1 M KOH. Referring to the electrochemical impedance spectra (EIS) FIG. 8B), the ohmic resistance was greatly decreased to 0.048 Ωcm$^2$ (at room temperature), 0.032 Ωcm$^2$ (45° C.), and 0.025 Ωcm$^2$ (60° C.) at 1.6 V with increasing temperature. As the water electrolysis cell temperature was increased, the current densities of all the water electrolysis cells were greatly improved along with an evident decrease in $R_{CT}$ due to the high electrode reactions and mass transport. Particularly, the water electrolysis cell using the PGM membrane electrode assembly of Example 6 reached a current density of 8.9 A/cm$^2$ at 2.0 V and 60° C. ($R_{ohm}$: ~0.025 Ωcm$^2$, $R_{CT}$: ~0.1 Ωcm$^2$). This performance is much higher than that of state-of-the-art PGM anion exchange membrane water electrolyzers reported so far and exceeds that of state-of-the-art proton exchange membrane water electrolyzers (6 A/cm$^2$ at 2.0 V), demonstrating the superiority of the inventive membrane electrode assembly for water electrolysis.

Experimental Example 4. Analysis of Performance of the PGM-Free Anion Exchange Membrane Water Electrolyzers Under Pure Water Conditions The water electrolysis cell using the PGM membrane electrode assembly including the PFTP-13 anion exchange membrane with high water diffusivity introduced therein was run by feeding pure water and its performance was evaluated. The performance of the water electrolysis cells using the PGM-free membrane electrode assemblies was measured while feeding 1 M KOH. The results are shown in FIGS. 9 and 10.

Figure 9A:
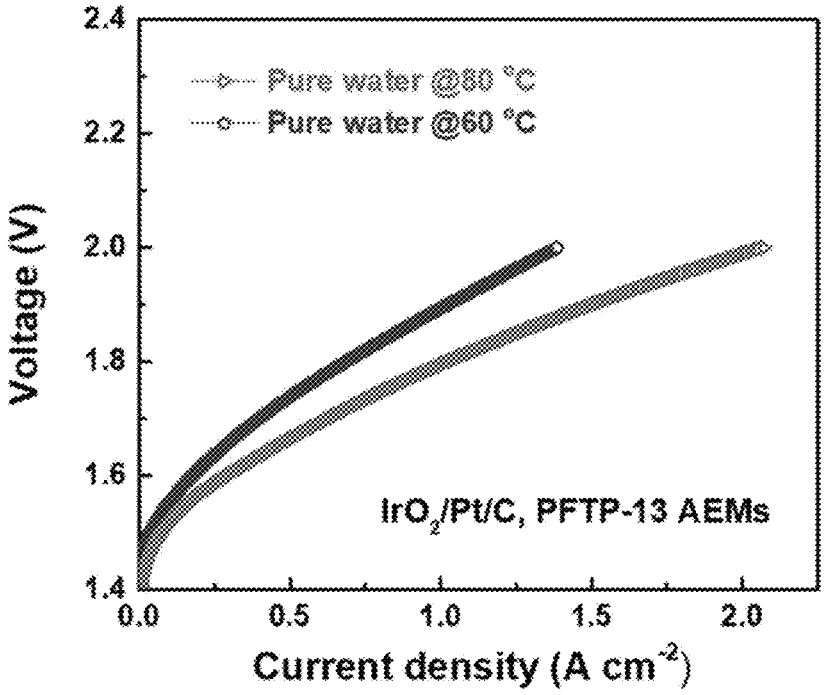
FIG. 9A shows performance of a water electrolysis cell using a PGM membrane electrode assembly fabricated in Example 4 under pure water conditions and FIG. 9B shows performance of water electrolysis cells using PGM-free membrane electrode assemblies fabricated in Example 7 and Comparative Example 4.
Figure 9B:
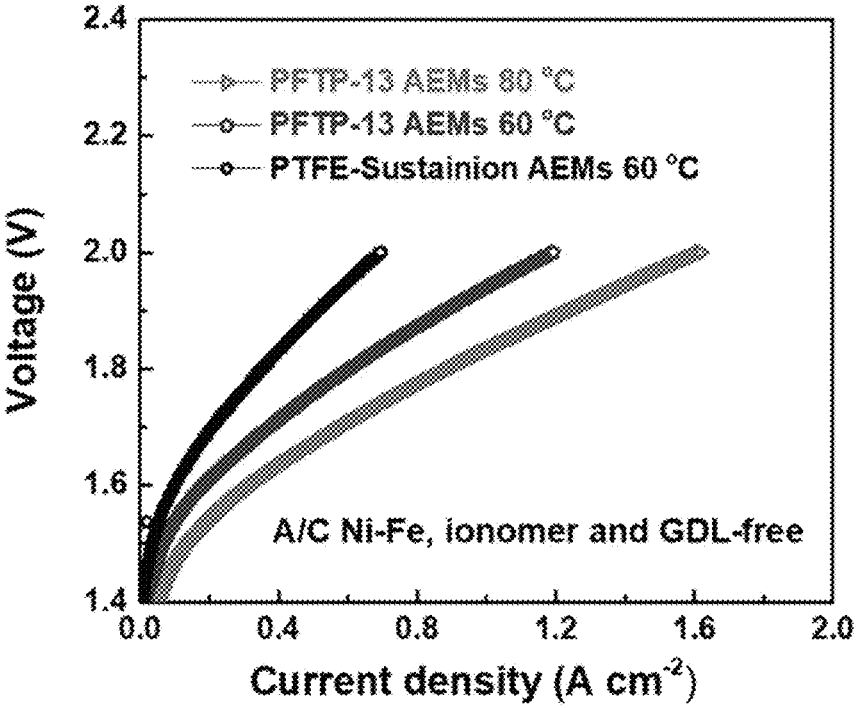

FIG. 9A shows performance of the water electrolysis cell using the PGM membrane electrode assembly fabricated in Example 4 under pure water conditions and FIG. 9B shows performance of the water electrolysis cells using the PGM-free membrane electrode assemblies fabricated in Example 7 and Comparative Example 4.

Figure 10A:
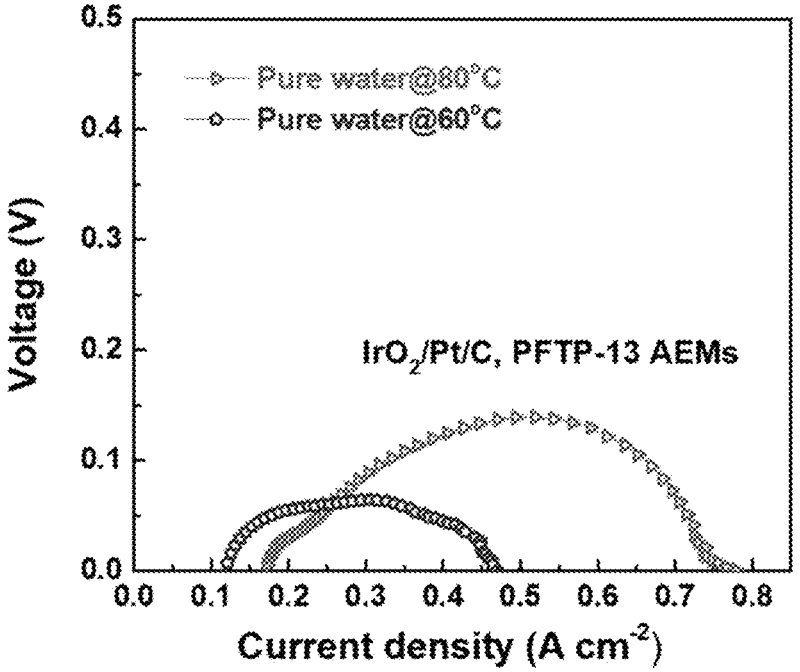
FIG. 10A shows electrochemical impedance spectra (EIS) of a water electrolysis cell using a PGM membrane electrode assembly fabricated in Example 4 under pure water conditions and FIG. 10B shows electrochemical impedance spectra (EIS) of water electrolysis cells using PGM-free membrane electrode assemblies fabricated in Example 7 and Comparative Example 4.
Figure 10B:
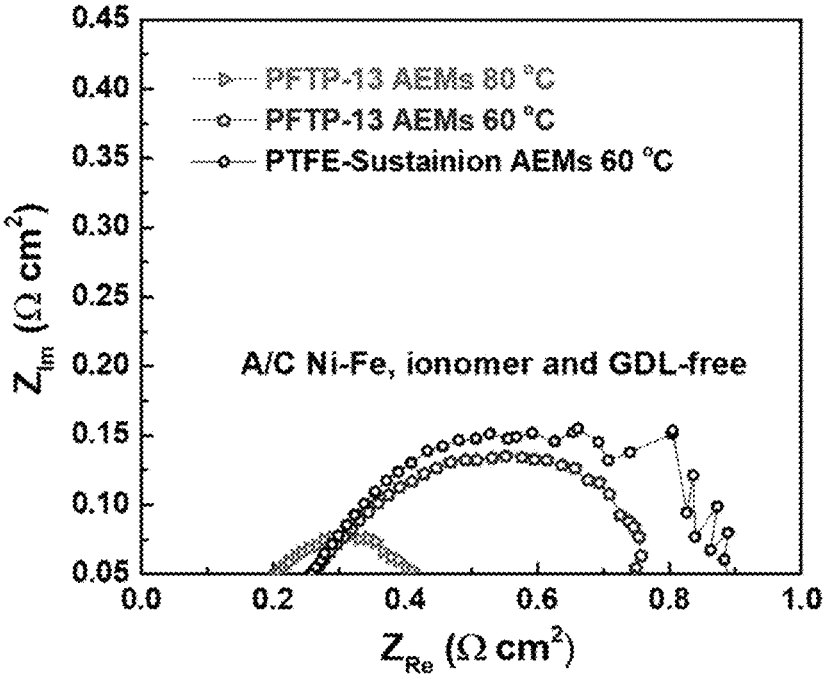

FIG. 10A shows electrochemical impedance spectra (EIS) of the water electrolysis cell using the PGM membrane electrode assembly fabricated in Example 4 under pure water conditions and FIG. 10B shows electrochemical impedance spectra (EIS) of the water electrolysis cells using the PGM-free membrane electrode assemblies fabricated in Example 7 and Comparative Example 4.

Referring to FIG. 9A, the water electrolysis cell using the PGM membrane electrode assembly of Example 4 reached a current density of 2.1 A/cm$^2$ in pure water at 2.0 V and 80° C. ($R_{ohm}$: 0.12 Ωcm$^2$, $R_{CT}$: 0.35 Ωcm$^2$). Considering that most state-of-the-art anion exchange membrane water electrolyzers operating under pure water conditions displayed a limited performance of below 1 A/cm$^2$ and anion exchange membrane water electrolyzers with the highest performance displayed a current density of 2.7 A/cm$^2$ at 85° C. and 1.8 V, the performance of the water electrolysis cell using the membrane electrode assembly of Example 4 reached a level equal to that of state-of-the-art anion exchange membrane water electrolyzers with the highest performance.

Referring to FIG. 9B and b) of FIGS. 10A and 10B, the water electrolysis cell using the PGM-free membrane electrode assembly of Example 7 reached current densities of 1.2 A/cm$^2$ ($R_{ohm}$: 0.25 Ωcm$^2$, $R_{CT}$: 0.5 Ωcm$^2$) and 1.6 A/cm$^2$ ($R_{ohm}$: 0.2 Ωcm$^2$, $R_{CT}$: 0.2 Ωcm$^2$) at temperatures of 60° C. and 80° C. and 2.0 V, respectively. The water electrolysis cell using the PGM-free membrane electrode assembly of Comparative Example 4 displayed a limited current density of 0.62 A/cm$^2$ with a similar $R_{ohm}$ value (~0.25 Ωcm$^2$) but with a much higher $R_{CT}$ (0.65 (2 cm$^2$). These results confirmed that although no ionomer was used in the anion exchange membrane water electrolyzer using the membrane electrode assembly of Example 7, which could significantly restrict the mass transportation and increase the cell resistance (both $R_{ohm}$ and $R_{CT}$) of the anion exchange membrane water electrolyzer, the current density of the anion exchange membrane water electrolyzer reached a level equal to that of state-of-the-art PGM-free anion exchange membrane water electrolyzers reported so far.

Experimental Example 5. In Situ Durability

The long-term in situ durabilities of the water electrolysis cell using the PGM and PGM-free membrane electrode assemblies prepared in Examples 1-7 and Comparative Examples 1~4 were measured at current densities of 0.5 A/cm$^2$ and 1 A/cm$^2$. The results are shown in FIGS. 11 to 13.

Figure 11A:
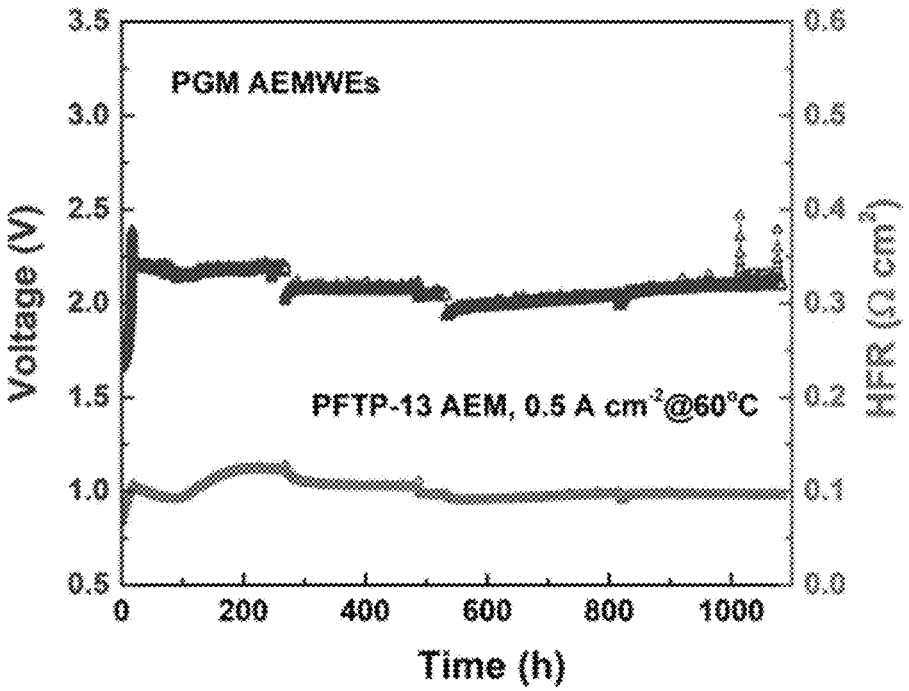
FIGS. 11A to 11C show in situ durabilities of a water electrolysis cell using a PGM membrane electrode assembly fabricated in Example 4 (FIG. 11A), a water electrolysis cell using a PGM-free membrane electrode assembly fabricated in Example 7 (FIG. 11B), a water electrolysis cell using a PGM-free membrane electrode assembly fabricated in Comparative Example 4 (FIG. 11C), which were measured under 0.5 A/cm$^2$ at 60° C.
Figure 11B:
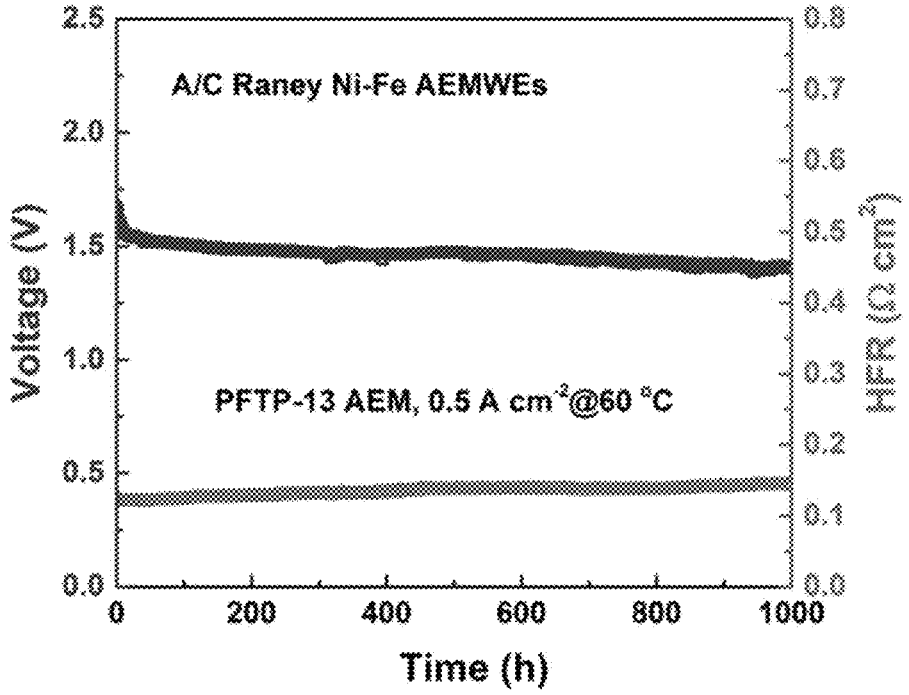
Figure 11C:
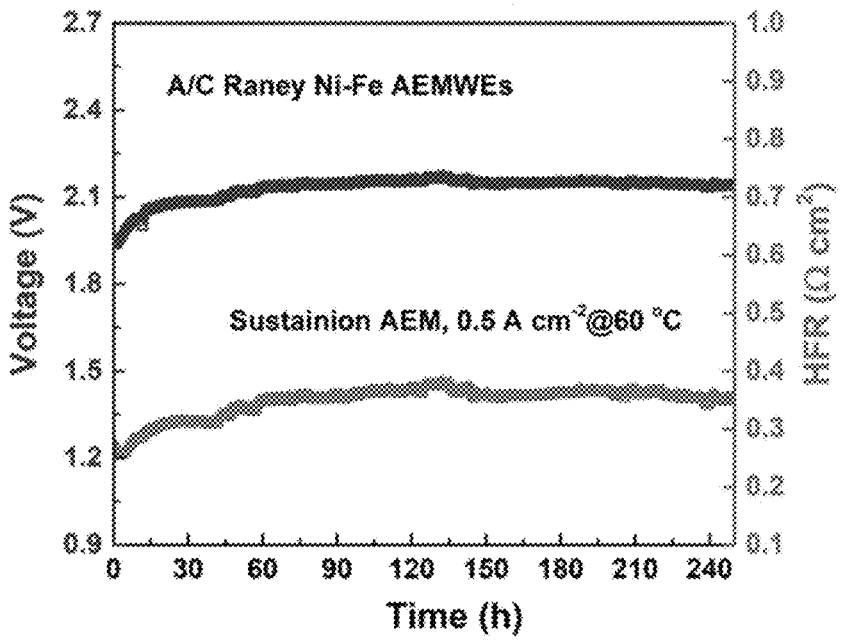

FIGS. 11A to 11C show in situ durabilities of the water electrolysis cell using the PGM membrane electrode assembly fabricated in Example 4 (FIG. 11A), the water electrolysis cell using the PGM-free membrane electrode assembly fabricated in Example 7 (FIG. 11B), the water electrolysis cell using the PGM-free membrane electrode assembly fabricated in Comparative Example 4 (FIG. 11C), which were measured under 0.5 A/cm$^2$ at 60° C.

Figure 12:
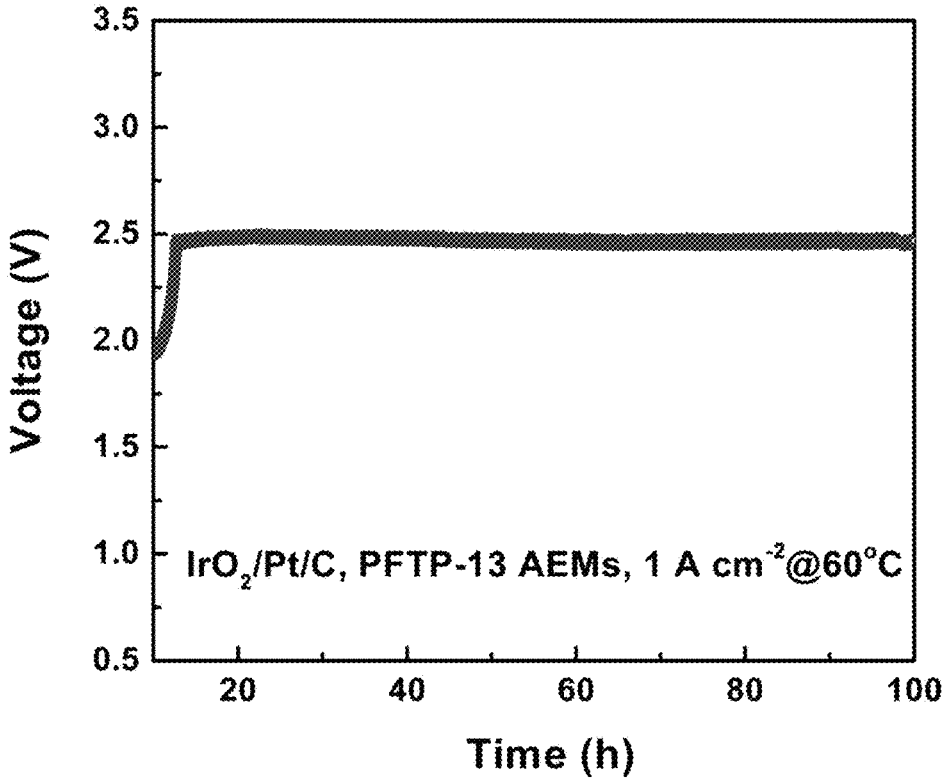
FIG. 12 shows in situ durability of a water electrolysis cell using a PGM membrane electrode assembly fabricated in Example 4, which was measured at 1 A/cm$^2$ and 60° C.

FIG. 12 shows in situ durability of the water electrolysis cell using the PGM membrane electrode assembly fabricated in Example 4, which was measured at 1 A/cm$^2$ and 60° C.

Figure 13:
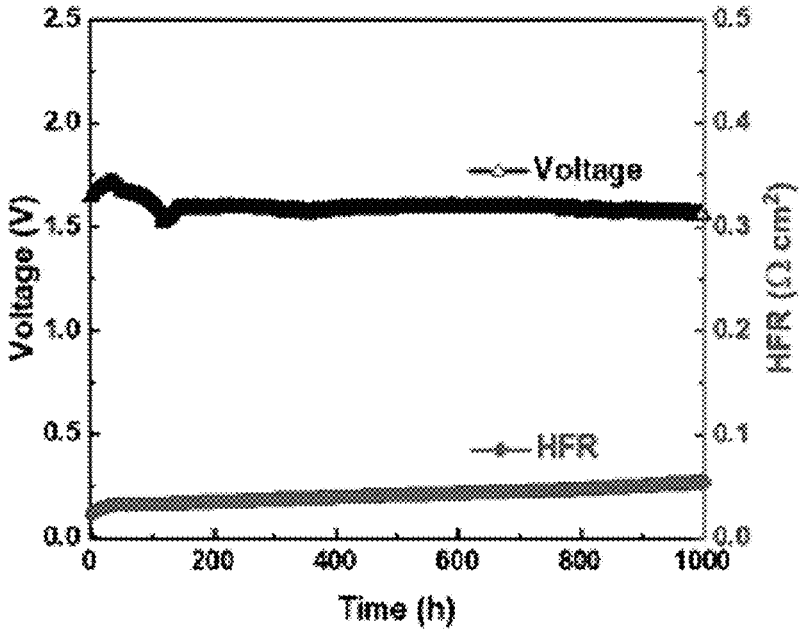
FIG. 13 shows in situ durability of a water electrolysis cell using a PGM membrane electrode assembly fabricated in Example 6, which was measured at 1 A/cm$^2$ and 60° C.

FIG. 13 shows in situ durability of the water electrolysis cell using the PGM membrane electrode assembly fabricated in Example 6, which was measured at 1 A/cm$^2$ and 60° C.

Referring to FIG. 11A, the water electrolysis cell using the PGM membrane electrode assembly fabricated in Example 4 could be operated under 0.5 A/cm$^2$ in 1 M KOH at 60° C. for ~1,100 h (HFR: ~0.08 (2 cm$^2$) with a low voltage decay (<200 μV/h). This initial voltage decay was probably due to catalyst activity loss or ionomer adsorption according to a recent report, while the voltage could be recovered partially during testing. Referring to FIG. 11B, the water electrolysis cell using the PGM-free membrane electrode assembly fabricated in Example 7 can be operated stably for ~1,000 h without any voltage decay (with a stable HFR, at ~0.15 (2 cm$^2$). Referring to FIG. 11C, the water electrolysis cell using the PGM-free membrane electrode assembly fabricated in Comparative Example 4 with a PGM-free catalyst exhibited a much higher voltage decay rate of 1200 μV/h and an improved cell resistance (HFR: from 0.25 $2 $cm^2$ to 0.35 (2 $cm^2$) after 250 h. Most of the currently reported anion exchange membrane water electrolyzers displayed very limited cell durability of less than 200 h at a low current density of 0.2 A/$cm^2$ along with a high voltage decay (>1,000 μV/h), while the water electrolyzer using the inventive membrane electrode assembly displayed a current density above 0.2 A/$cm^2$ and good in situ durability of more than 200 h (with no voltage decay) in 1 M KOH.

Referring to FIG. 13, the water electrolysis cell using the PGM membrane electrode assembly fabricated in Example 6 could be operated under 1.0 A/$cm^2$ in 1 M KOH at 60° C. for ~50 h with a low voltage decay (<200 μV/h). Thereafter, the voltage was again maintained at 1.5 V and the water electrolysis cell could be operated stably for ~1,000 h (HFR: ~0.045 (2 $cm^2$). This initial voltage decay was probably due to catalyst activity loss or ionomer adsorption according to a recent report, while the voltage could be recovered partially during testing. Most of the currently reported anion exchange membrane water electrolyzers displayed very limited cell durability of less than 200 h at a low current density of 0.2 A/$cm^2$ along with a high voltage decay (>1,000 μV/h), while the water electrolyzer using the inventive membrane electrode assembly displayed a current density above 0.2 A/$cm^2$ and good in situ durability of more than 200 h (with no voltage decay) in 1 M KOH.

Figure 14:
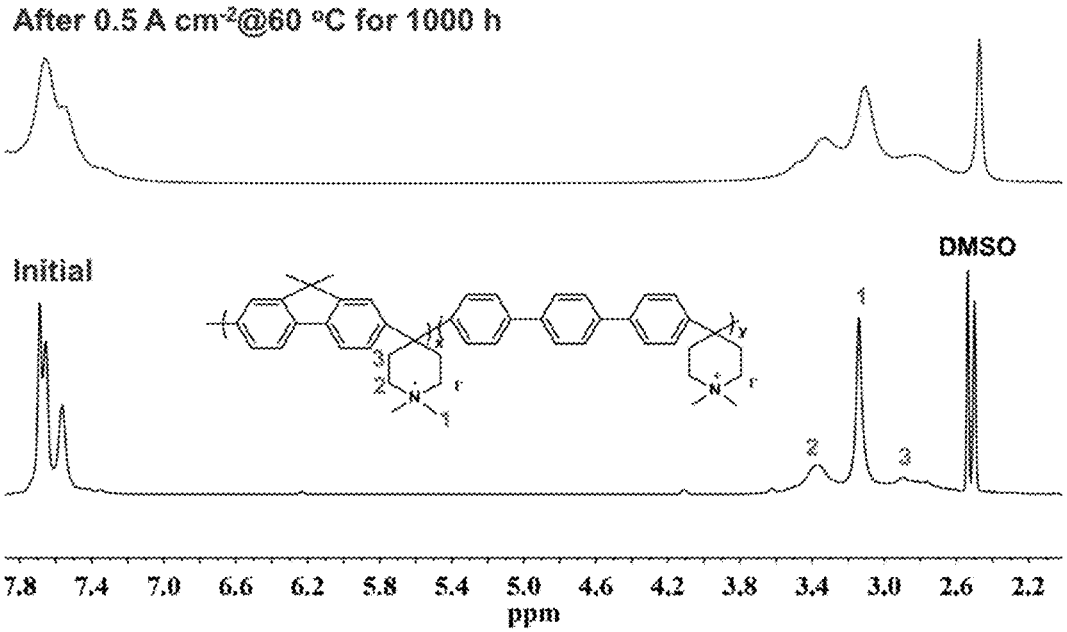
FIG. 14 shows $^1$H NMR spectra of a water electrolysis cell using a PGM membrane electrode assembly fabricated in Example 4 before and after in situ durability evaluation under 0.5 A/cm$^2$ at 60° C. for 1000 hours.

FIG. 14 shows 1H NMR spectra of the water electrolysis cell using the PGM membrane electrode assembly fabricated in Example 4 before and after in situ durability evaluation under 0.5 A/$cm^2$ at 60° C. for 1000 hours. For 1H NMR measurement, DMSO-d6 was used as solvent, and 10% TFA was added to remove the water effect. Referring to FIG. 14, the 1H NMR measurement revealed that no degradation of the anion exchange membrane and ionomers was observed in the inventive PGM membrane electrode assembly of Example 4 after 1,100 h of in situ durability testing.

What is claimed is:

1. A membrane electrode assembly for water electrolysis, comprising: an anion exchange membrane comprising a first polymer; a cathode located on one surface of the anion exchange membrane; and an anode located on the other surface of the anion exchange membrane, wherein the first polymer comprises at least one repeating unit represented by Formula 2:

(2)

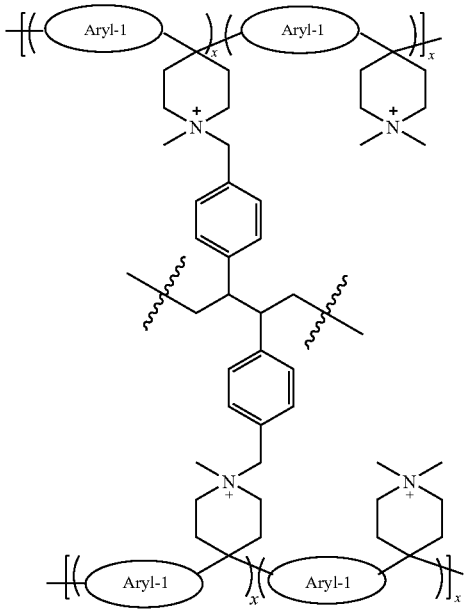

-continued

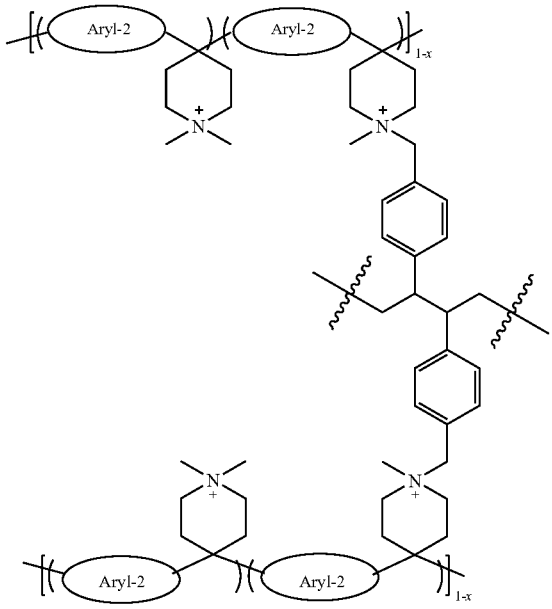

wherein each Aryl-1 is

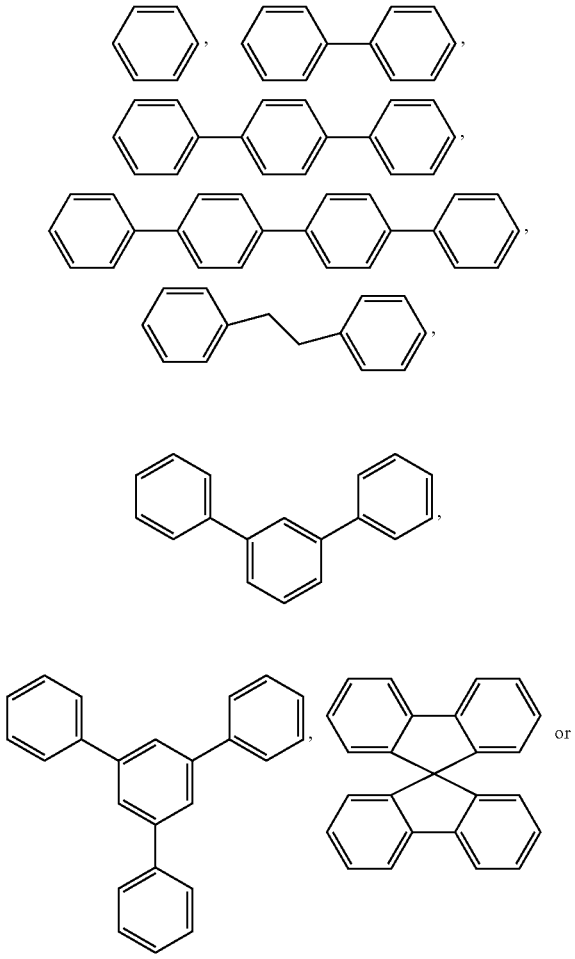

-continued

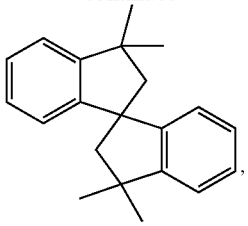

each Aryl-2 is

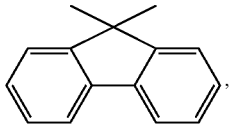

and x and 1-x represent the mole fractions of the corresponding repeating units; and wherein the ratio x: 1-x in Formula 2 is 0.7:0.3 to 0.97:0.03 and the degree of crosslinking of the first polymer is 1% to 30%.

2. The membrane electrode assembly according to claim 1, wherein the cathode and the anode each independently comprise at least one metal selected from the group consisting of platinum, ruthenium, rhodium, palladium, osmium, and iridium.

3. The membrane electrode assembly according to claim 1, wherein the anode and the cathode each independently comprise at least one non-platinum group metal-based catalyst selected from the group consisting of Ni—Fe, Ni—$Fe_2O_4$, Ni—Mo, Fe—NiMo—$NH_3$, NiMo$NH_3$, Ni, Mn, Co, Cr, Sn, Zn, and Ce.

4. A membrane electrode assembly for water electrolysis, comprising: an anion exchange membrane comprising a first polymer; a cathode located on a first surface of the anion exchange membrane; and an anode located on a second surface opposite to the first surface of the anion exchange membrane, wherein the cathode comprises a cathode ionomer comprising a second polymer, the anode comprises an anode ionomer comprising a third polymer, the first polymer has a repeating unit represented by Formula 6 or 7:

(6)

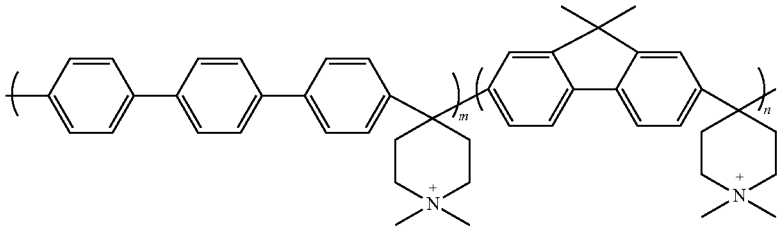

wherein m and n represent the mole fractions (%) of the corresponding repeating units and satisfy m+n=100, and the ratio min is 85:15 to 90:10, (7)

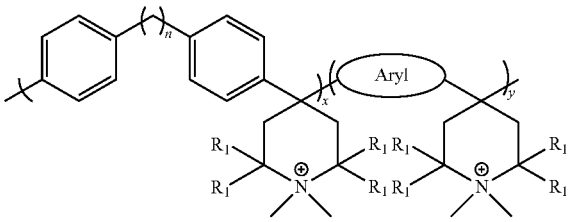

wherein Aryl is

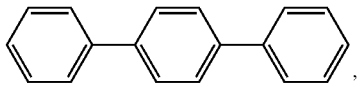

n is 2, $R_1$ is hydrogen, x and y represent the mole fractions (%) of the corresponding repeating units and satisfy x+y=100, and the ratio x:y is 23:77 to 30:70, the second polymer has a repeating unit represented by Formula 8:

(8)

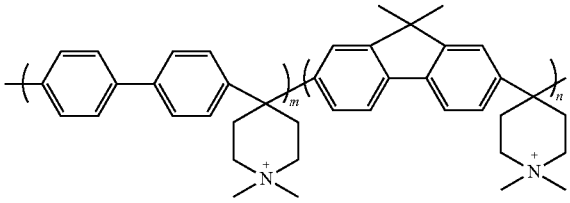

wherein m and n represent the mole fractions (%) of the corresponding repeating units and satisfy m+n=100, and the ratio min is 83:17 to 90:10, the third polymer has a repeating unit represented by Formula 9:

(9)

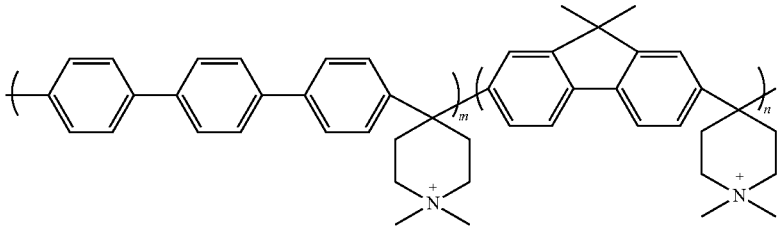

wherein m and n represent the mole fractions (%) of the corresponding repeating units and satisfy m+n=100, and the ratio min is 91:9 to 95:5, the second polymer is present in an amount of 24 to 26% by weight, based on the total weight of the cathode, and the third polymer is present in an amount of 7 to 15% by weight, based on the total weight of the anode.

5. A water electrolysis cell comprising the membrane electrode assembly for water electrolysis according to claim 1.

* * * * *